US005949377A

United States Patent [19]

Matsumoto et al.

[11] Patent Number: 5,949,377

[45] Date of Patent: Sep. 7, 1999

[54] RETRACTABLE, EXTENDABLE AND ROTATABLE DUAL ANTENNA SYSTEM

[75] Inventors: Wataru Matsumoto; Makoto Takemoto; Tsutomu Endo, all of Tokyo, Japan

[73] Assignee: Mitsubishi Denki Kabushiki Kaisha, Tokyo, Japan

[21] Appl. No.: 08/718,265

[22] Filed: Sep. 20, 1996

[30] Foreign Application Priority Data

Sep. 22, 1995 [JP] Japan ..... 7-244446
Aug. 21, 1996 [JP] Japan ..... 8-219947

[51] Int. Cl.[6] ..... H01Q 1/24

[52] U.S. Cl. ..... 343/702; 343/725; 343/729

[58] Field of Search ..... 343/702, 900, 343/901, 895, 725, 729; H01Q 1/24

[56] References Cited

U.S. PATENT DOCUMENTS

| | | | |
|---|---|---|---|
| 3,522,608 | 8/1970 | Von Fange | 343/702 |
| 3,798,651 | 3/1974 | Lehman | 343/702 |
| 4,024,542 | 5/1977 | Ikawa et al. | 343/702 |
| 5,374,937 | 12/1994 | Tsunekawa et al. | 343/702 |
| 5,438,339 | 8/1995 | Itoh et al. | 343/702 |
| 5,467,097 | 11/1995 | Toko | 343/702 |
| 5,617,105 | 4/1997 | Tsunekawa et al. | 343/702 |
| 5,644,320 | 7/1997 | Rossi | 343/702 |

FOREIGN PATENT DOCUMENTS

| | | |
|---|---|---|
| 0508299 | 4/1992 | European Pat. Off. . |
| 0617520 | 3/1994 | European Pat. Off. . |
| 0650215 | 9/1994 | European Pat. Off. . |
| 3245603 | 11/1991 | Japan . |
| 5-50816 | 7/1993 | Japan . |
| 7-86819 | 3/1995 | Japan . |
| 7321524 | 12/1995 | Japan . |
| 2253949 | 9/1992 | United Kingdom . |

*Primary Examiner*—Michael C. Wimer

[57] ABSTRACT

An antenna device includes a first antenna capable of moving between a storage position where the first antenna is contained within an equipment housing and an extended position where the first antenna is pulled out of the device housing for receiving and/or transmitting a signal. A second antenna is attached to the tip of the first antenna for receiving and/or transmitting a signal when the first antenna assumes the storage position. The rotator rotates the first antenna with respect to the device housing in the extended position.

13 Claims, 31 Drawing Sheets

RETRACTABLE, EXTENDABLE AND ROTATABLE DUAL ANTENNA SYSTEM

BACKGROUND OF THE INVENTION

1. Field of the Invention

The present invention generally relates to antenna devices for use in electronic devices such as portable radio communication devices.

2. Description of the Prior Art

Antenna devices are generally required for electronic devices for receiving and transmitting radio signals. When a user carries such an electronic device, an antenna device is preferably contained within the equipment housing because the antenna device should be protected from any damage during carriage.

Japanese Patent Laid-open No. 7-86819, for instance, discloses an antenna device capable of transmitting and receiving signals from when either within or out of the equipment housing. The antenna device comprises a pole-shaped first antenna which moves axially between a storage position where the first antenna is contained within the equipment housing, and an extended position where the first antenna is pulled out of the equipment housing. The antenna device is capable of transmitting and receiving signals with a second antenna which is attached to the tip of the first antenna so as to protrude from the equipment housing while the first antenna assumes a storage position.

A conventional antenna device is adapted to adjust the extent of the first antenna outside of the equipment housing in the extended position. The direction of the first antenna, however, cannot be adjusted.

SUMMARY OF THE INVENTION

An object of the present invention is thus to provide an antenna device capable of adjusting the direction of a first antenna at its extended position.

According to a first aspect of the present invention, there is provided an antenna device comprising: a first antenna capable of moving between a storage position where the first antenna is contained within an equipment housing and an extended position where the first antenna is pulled out of the equipment housing for receiving and/or transmitting a signal; a second antenna attached to a tip of the first antenna for receiving and/or transmitting a signal when the first antenna assumes the storage position; and rotation means capable of rotating the first antenna in the extended position with respect to the equipment housing.

With the above arrangement, it is possible to easily match a polarization plane with a received signal irrespective of the direction of the equipment housing. Of course, the second antenna can receive a signal with high efficiency even when the first antenna assumes the storage position.

The rotation means may comprise: a conductive shaft attached to the equipment housing; a rotator rotating about the conductive shaft; and a through hole formed in the rotator, the through hole supporting the second antenna when the first antenna assumes the storage position and the first antenna when the first antenna assumes the extended position.

A signal feeder may be provided in the through hole for contacting the second antenna when the through hole supports the second antenna and for contacting the first antenna when the through hole supports the first antenna, so that the signal is supplied to the first and second antennas through the signal feeder. The signal feeder can commonly supply a signal to the first and second antennas, thereby leading to a facilitated structure.

If the first and second antennas are connected to each other via an insulator, irradiation of a signal from the first antenna can be prevented even when the first antenna is contained within the equipment housing. On the other hand, the first and second antennas may be directly connected to each other so that the mechanical strength can be improved in a connection between the first and second antennas.

At least one of the first and second antennas may comprise either a helical antenna or a meander line antenna for reducing the height of the antenna. Further, the first antenna may comprise either a linear antenna or a planar antenna for reducing antenna thickness.

If the first and second antennas are set to have electrical length of a quarter wavelength, it is possible to omit a matching circuit. The electrical length may be in a range of a quarter to half wavelength. Additionally, if the electrical length becomes longer over a half wavelength, the directivity can be improved in the horizontal direction.

The first antenna may rotate in a plane perpendicular to a surface of the equipment housing. The first antenna may also rotate in a plane inclined with respect to a surface of the equipment housing by an angle less than or equal to 90 degrees so that the tip of the antenna comes closer to the equipment housing. The first antenna may rotate in a range of 180 degrees.

The antenna device may further comprise a withdrawal prevention piece for preventing the first antenna from withdrawing from the extended position when the first antenna is rotated with respect to the equipment housing. The withdrawal prevention piece serves to reliably maintain an electrical connection between the first antenna and the signal feeder.

The antenna device may further comprise a click mechanism for temporarily holding the rotation means when the withdrawal prevention piece prevents the first antenna from withdrawing from the extended position. The reliable electrical connection can be further enhanced.

According to a second aspect of the present invention, there is provided an antenna device comprising: a first antenna capable of moving between a storage position where the first antenna is contained in an equipment housing and an extended position where the first antenna is pulled out of the equipment housing for receiving and/or transmitting a signal; and a second antenna attached to a tip of the first antenna for receiving and/or transmitting a signal when the first antenna assumes the storage position, wherein the first antenna comprises a support piece supported on the equipment housing when the first antenna assumes the extended position and a tip piece connected to the support piece for swinging movement so as to support the second antenna.

With the above arrangement, it is possible to easily match a polarization plane with a received signal, irrespective of the direction of the equipment housing. Of course, the second antenna can receive a signal with high quality even when the first antenna assumes the storage position.

The support piece may be rotatably supported on the equipment housing so as to widen the movement of the first antenna. In addition, the first antenna may at least partly comprise a flexible arm.

According to a third aspect of the present invention, there is provided an antenna device comprising: a first antenna capable of moving between a storage position where the first antenna is contained within an equipment housing and an extended position where the first antenna is pulled out of the equipment housing for receiving and/or transmitting a signal; and a second antenna attached to an external surface of the equipment housing for receiving and/or transmitting a signal when the first antenna assumes the storage position, wherein the first antenna comprises a support piece supported by the equipment housing when the first antenna assumes the extended position and an tip piece connected to the support piece for swinging movement.

With the above arrangement, it is possible to easily match a polarization plane with a received signal irrespective of the direction of the equipment housing. Of course, the second antenna can receive a signal with high efficiency even when the first antenna assumes the storage position. The support piece may be rotatably supported on the equipment housing so as to widen the movement of the first antenna.

The second antenna may be covered with an elastic member. This elastic member can protect the second antenna from impact and may be provided with a protection piece for protecting a connection between the support and tip pieces so as to strengthen a relatively weak portion.

The signal may be supplied to both the first and second antennas when the first antenna assumes the storage position. The signal may be supplied to both the first and second antennas when the first antenna assumes the extended position. Otherwise, the signal may be supplied only to the second antenna when the first antenna assumes the storage position.

According to a fourth aspect of the present invention, there is provided an antenna device comprising: a first antenna capable of moving between a storage position where the first antenna is contained within an equipment housing and an extended position where the first antenna is pulled out of the equipment housing; and a second antenna disposed in the equipment housing electromagnetically connected to the first antenna, wherein said first antenna comprises a support piece supported on the equipment housing when the first antenna assumes the extended position and a tip piece connected to the support piece for swinging movement.

With the above arrangement, it is possible to easily match a polarization plane with a received signal irrespective of the direction of the equipment housing. The second antenna can receives a signal with high efficiency even when the first antenna assumes the storage position. The support piece may be rotatably supported on the equipment housing.

The antenna device may further comprise a support means attached to the equipment housing for protruding the first antenna from a surface of the equipment housing when the first antenna assumes the storage position.

The second antenna may be positioned offset from other metallic members within the equipment housing, thereby avoiding interference with such members. The second antenna comprises either a notch antenna or a slot antenna. In this case, if an impedance of the second antenna is matched, a matching circuit is not necessary for the first antenna. The second antenna may comprise a meander line or helical antenna.

According to a fifth aspect of the present invention, there is provided an antenna device comprising: an antenna capable of moving between a storage position where the antenna is contained within an equipment housing with a tip protruding from the equipment housing and an extended position where the antenna is pulled out of the equipment housing; a conductive rotation means rotatably supported on the equipment housing for insulatedly supporting the antenna; a signal source capable of supplying a signal to the rotation means; and a reactance element provided between the signal source and the rotation means for oscillating by a capacitance formed between a tip of the antenna and the rotation means when the signal source supplies the signal.

According to a sixth aspect of the present invention, there is provided an antenna device comprising: an antenna capable of moving between a storage position where the antenna is contained within an equipment housing and an extended position where the antenna is pulled out of the equipment housing; and an impedance matching means contacting the antenna at the storage position for matching an impedance of the antenna.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and the other objects, features and advantages will be further apparent from the following description of the preferred embodiment taken in conjunction with the accompanying drawings wherein.

DESCRIPTION OF THE PREFERRED EMBODIMENTS

Figure 1:
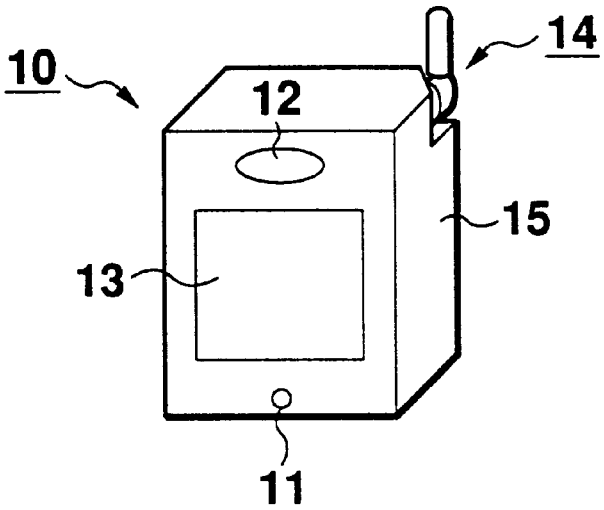
FIG. 1 is a perspective view of a portable information terminal employing an antenna device according to a first embodiment of the present invention.

FIG. 1 illustrates a portable information terminal or PDA 10 employing an antenna device according to a first embodiment of the present invention. The portable information terminal 10 can function as a cellular phone. A user may input speech via a microphone 11 and hear voice via a speaker 12. A user can make a call using dial keys displayed on an LCD (liquid crystal display) 13 or input various information into the portable information terminal 10 via icons displayed on the LCD 13.

Figure 2:
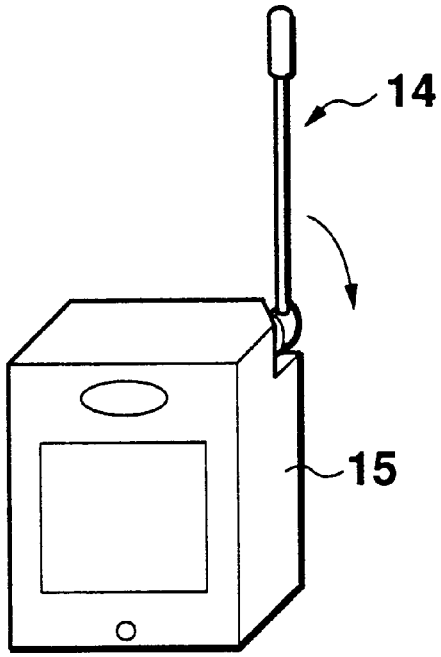
FIG. 2 is a perspective view of the portable information terminal illustrating an extended position of the antenna assembly.
Figure 3:
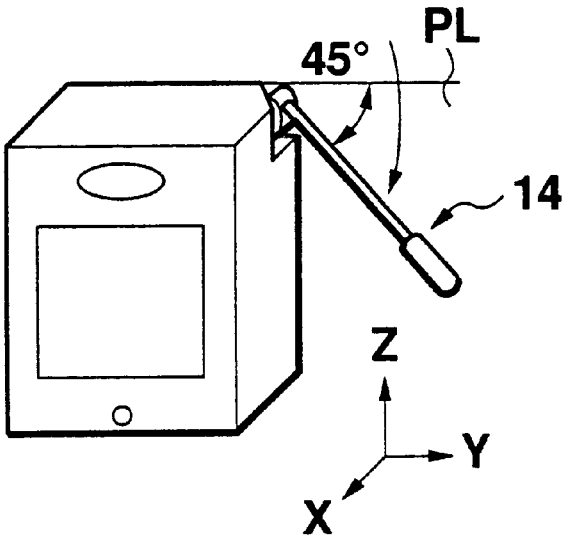
FIG. 3 is a perspective view of the portable information terminal illustrating rotation of the antenna assembly.
Figure 4:
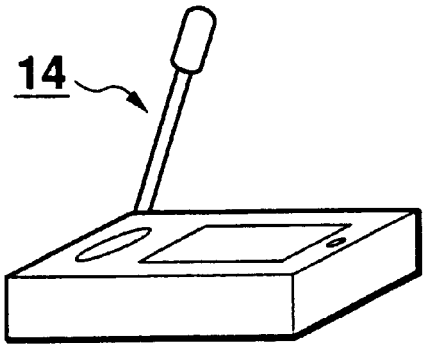
FIG. 4 illustrates a portable information terminal in use.

An antenna assembly 14 operates both in a storage position where the antenna assembly 14 is contained within a housing 15 as shown in FIG. 1 and in an extended position where the antenna assembly 14 is pulled out of the housing 15 as shown in FIG. 2. The antenna assembly 14 can rotate within a plane inclined by 45 degrees to the Y-Z axes reference plane PL of the portable information terminal 10 at the extended position as shown in FIG. 3. Accordingly, when placing the portable information terminal 10 on a horizontal plane, a standing position of the antenna assembly 14 allows a high antenna gain to a vertical polarization from an antenna of a base station.

The antenna assembly 14 comprises a whip antenna 20 with the electrical length of a half wavelength as a first antenna made from metallic material such as stainless steel, and a helical antenna 21 with the electrical length of a half wavelength as a second antenna attached to the tip of the whip antenna 20. The whip antenna 20 and the helical antenna 21 are insulated from each other by an insulator 22. The helical antenna 21 comprises a spiral metallic wire 23 and a synthetic resin body 24 in which the wire 23 is embedded. The synthetic resin body 24 serves to hold the shape of the wire 23.

Figure 5:
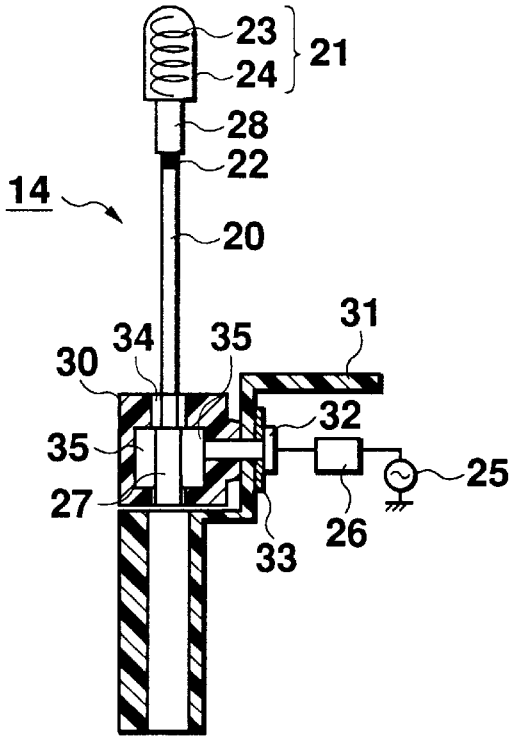
FIG. 5 is an enlarged sectional view of the antenna device in the ex tended position.

A high-frequency signal is supplied to the antenna assembly 14 from a high-frequency signal source 25 via a matching circuit 26. The antenna assembly 14 at the extended position, as shown in FIG. 5, receives a signal with the whip antenna 20 through a first electrical feeder 27 which is attached to the base end of the whip antenna 20. The antenna assembly 14 at the storage position, as shown in FIG. 6, receives a signal with the helical antenna through a second electrical feeder 28 which is formed at the base end of the helical antenna 21.

Figure 7:
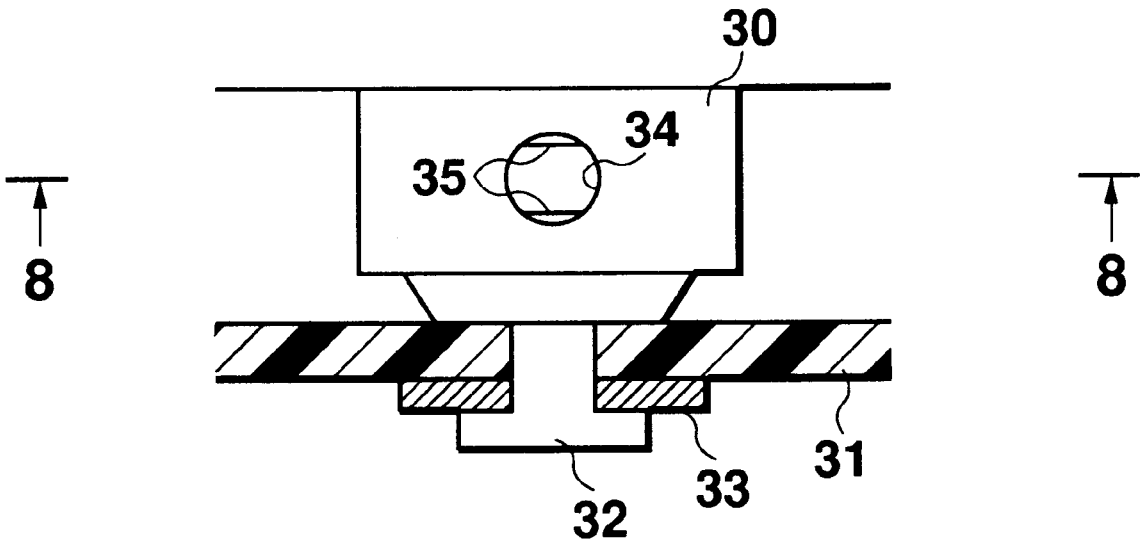
FIG. 7 is a partial sectional view of a rotator from the above.
Figure 8:
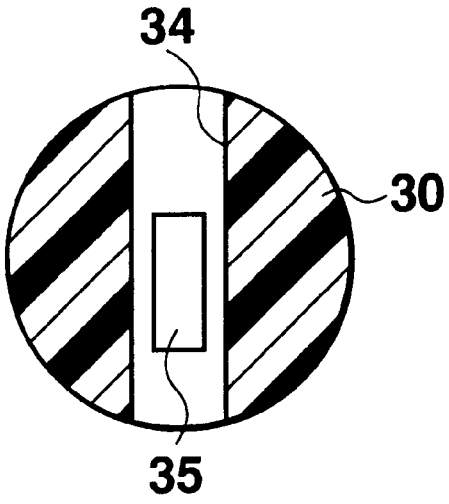
FIG. 8 is a sectional view along the line 8—8 in FIG. 7.

Referring to FIGS. 7 and 8, the antenna assembly 14 is supported for rotation on a housing wall 31 with a synthetic resin rotator 30. The rotator 30 is attached to the housing wall 31 through a metallic shaft 32. A fix nut 33 is inserted between the flange of the metallic shaft 32 and the inner surface of the housing wall 31. A through hole 34 is formed in the rotator 30 for receiving the antenna assembly 14 in a direction perpendicular to the rotation axis of the rotator 30. A spring member 35 is disposed within the through hole 34 serving as a signal feeder. When the antenna assembly 14 assumes the extended position, the first electrical feeder 27 is held by the elasticity of the spring member 35 so that a signal is supplied to the whip antenna 20 through the shaft 32 and the spring member 35 from the high-frequency signal source 25. When the antenna assembly 14 assumes the storage position, the second electrical feeder 28 is held by the elasticity of the spring member 35 so that a signal is supplied to the helical antenna 20 through the shaft 32 and the spring member 35 from the high-frequency signal source 25. It should be noted that the flange of the first electrical feeder 27 serves to prevent the antenna assembly from completely withdrawing from the rotator 30.

The operation of the antenna device will next be described. When the antenna assembly 14 is completely pulled out to the extended position as shown in FIG. 5, the first electrical feeder 27 of the whip antenna 20 enters the through hole 34 so that the first electrical feeder 27 is held by the spring member 35. A high-frequency signal is fed to the whip antenna 20 from the high-frequency signal source 25 through the first electrical feeder 27, the shaft 32, and the matching circuit 26. The whip antenna 20 protruding from the housing 15 radiates radio waves. The insulator 22 serves to prevent the helical antenna 21 from receiving a high-frequency signal.

Figure 6:
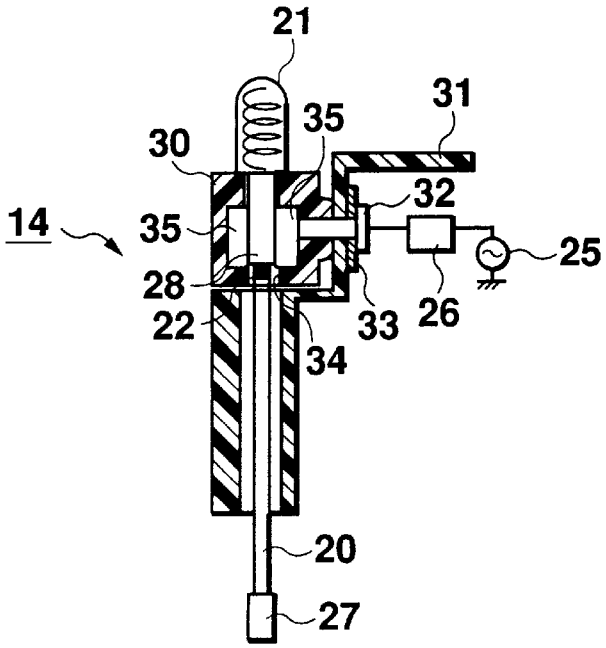
FIG. 6 is an enlarged sectional view of the antenna device in the storage position.

When the antenna assembly 14 is pushed into the storage position as shown in FIG. 6, the second electrical feeder 28 of the helical antenna 21 is held by the spring member 35. A high-frequency signal is fed to the helical antenna 21 from the high-frequency signal source 25 through the second electrical feeder 28, the shaft 32, and the matching circuit 26. The helical antenna 21 protruding from the housing 15 radiates radio waves. The insulator 22 likewise serves to prevent the whip antenna 20 from receiving a high-frequency signal.

As described above, the first embodiment allows the helical antenna 21 to efficiently transmit and/or receive a signal having electrical length of a half wavelength, even when the whip antenna 20 is contained in the housing 15. In addition, the whip antenna 20 does not receive high-frequency signals in the storage position, so that radio waves are not radiated from the whip antenna 20 within the housing 15. Electronic parts within the housing 15 operate reliably.

Placing the portable information terminal on a desk or the like may facilitate an input operation to the LCD 13 on the front surface of the portable information terminal 10. Raising the whip antenna 20 allows the antennas polarization plane to match that of radio waves from a base station, thereby achieving a high antenna gain. Further, since the first embodiment allows the antenna assembly 14 to rotate in a plane inclined by 45 degrees from the X-Y axes reference plane PL as shown in FIG. 3, input operations are not hindered, as may be caused by excessive approach of the antenna assembly 14 to the portable information terminal 10.

Figure 9:
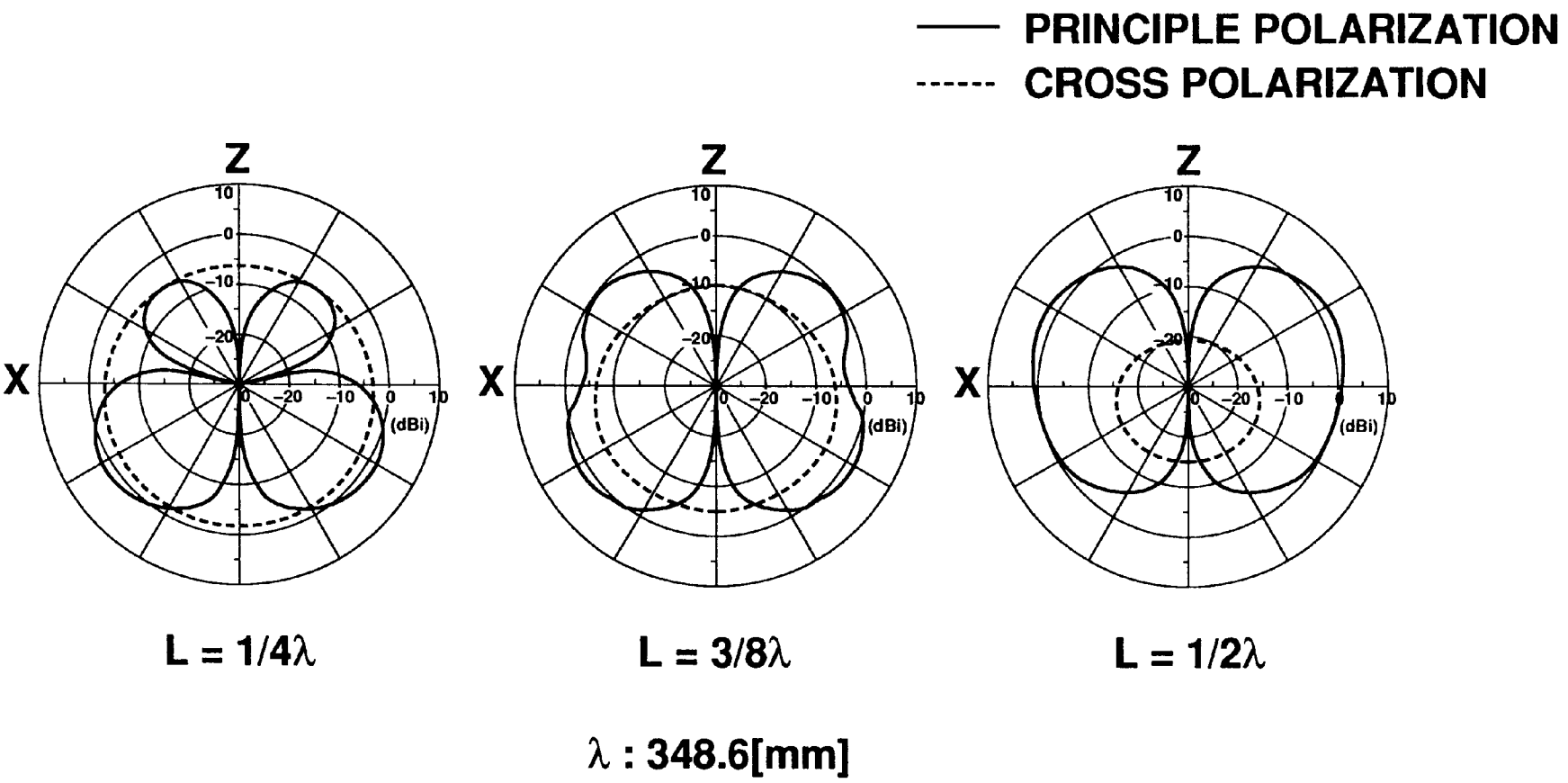
FIG. 9 illustrates variations in radiation pattern depending on electrical length.
Figure 10:
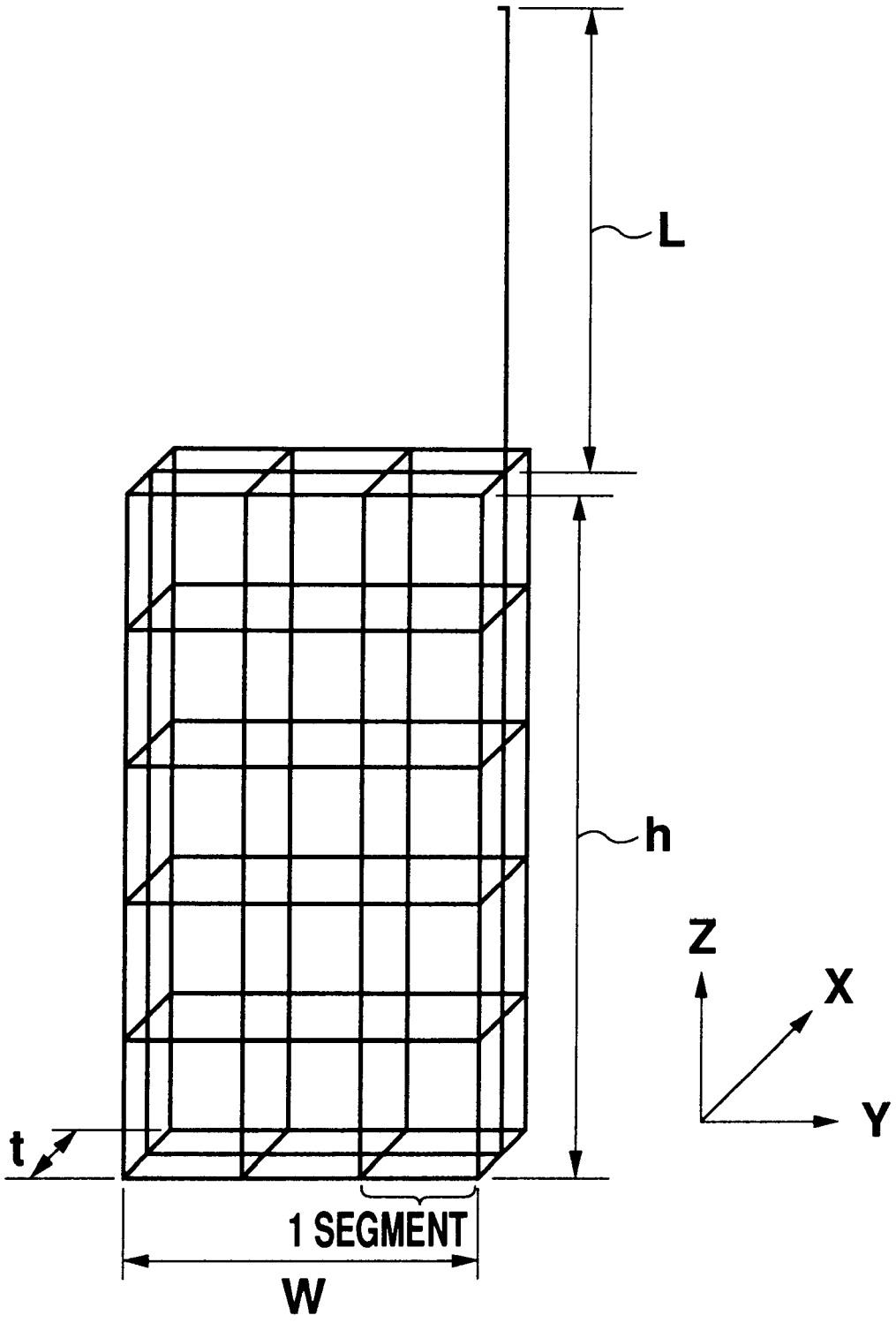
FIG. 10 schematically illustrates a wire grid model.

The electrical length of the whip and helical antennas 20, 21 may be set at a quarter, instead of a half, wavelength. The electrical length of a quarter wavelength allows an impedance of the antenna device to approach 50 ohms, which allows omission of the matching circuit 26. Specifically, assume that a whip antenna having electrical length $L-\frac{1}{4}\lambda$, $\frac{3}{8}\lambda$ and $\frac{1}{2}\lambda$ radiate radio waves having wavelength $\lambda=348.6$ mm. The radiation patterns of FIG. 9 are illustrated by simulation of the moment method using the wire grid model as shown in FIG. 10. It is apparent that a larger electrical length improves directivity in the horizontal direction. The results have proved that the electrical length of a whip antenna may be set at a half wavelength for emphasizing a directivity in the horizontal direction, while being set at a quarter wavelength for omitting a matching circuit. Larger electrical length, over a half wavelength, further allows improved directivity in the horizontal direction.

Figure 11:
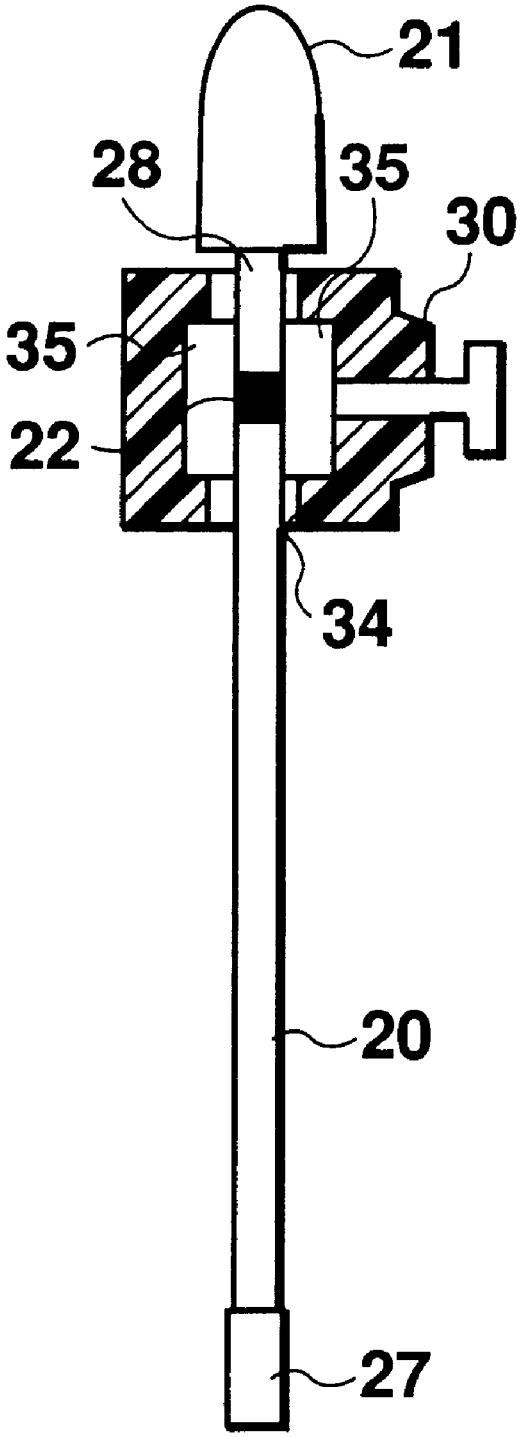
FIG. 11 illustrates an antenna device according to a second embodiment of the present invention.

FIG. 11 illustrates an antenna device according to a second embodiment of the present invention. The second embodiment is characterized in that the spring member 35 holds both the whip and helical antennas 20, 21 when the whip antenna 20 assumes the storage position. The whip and helical antennas 20, 21 both receive a common external force even when the rotator 30 accidentally rotates, so that stress is not concentrated on the insulator 22, thereby protecting a relatively weak connection between the whip and helical antennas 20, 21. The strength of the antenna assembly 14 can be enhanced accordingly. For instance, a constant diameter for the whip antenna 20, the insulator 22, and the second electrical feeder 28 as shown in FIG. 11 enables the spring member 35 to simultaneously hold the whip and helical antennas 20, 21. It should be noted that the same reference numerals are attached to elements having the same function as those of the first embodiment.

Figure 12:
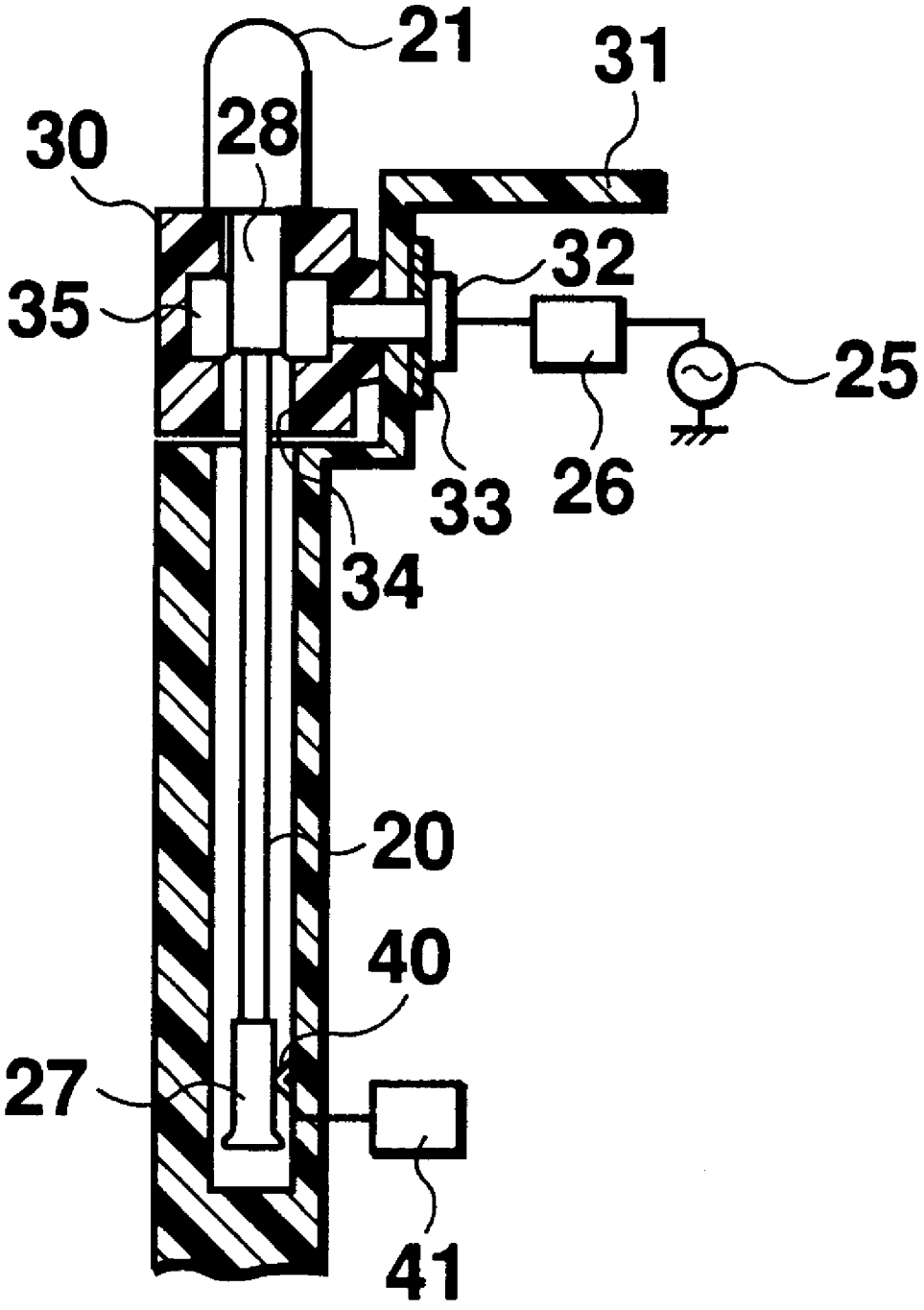
FIG. 12 illustrates an antenna device according to a third embodiment of the present invention.

FIG. 12 illustrates an antenna device according to the third embodiment of the present invention. The third embodiment is characterized in that the whip and helical antennas 20, 21 are electrically connected to each other. As shown in FIG. 12, the first electrical feeder 27 of the whip antenna 20 is electrically connected to an impedance control circuit 41 through a metallic contact spring 40 when the antenna assembly 14 assumes the storage position. The same reference numerals are attached to elements having the same function as those of the first and second embodiments.

The third embodiment allows the whip and helical antennas 20, 21 to receive a high-frequency signal through the first electrical feeder 27, the spring member 35, the shaft 32, and the matching circuit 26 when the antenna assembly 14 assumes the extended position. The matching circuit 26 has a constant which is set to match a combined impedance of the whip and helical antennas 20, 21.

When the antenna assembly 14 is in the storage position, the whip and helical antennas 20, 21 receive a high-frequency signal through the second feeder 28, the spring member 35, the shaft 32, and the matching circuit 26. Contact of the first electrical feeder 27 with the contact spring 40 enables the impedance control circuit 41 to match only the impedance of the helical antenna 21. Accordingly, radiation efficiency cannot be reduced. Further, a connection between the whip and helical antennas 20, 21 can be strengthened or enhanced in the antenna assembly 14 due to direct connection between the whip and helical antennas 20, 21.

Figure 13:
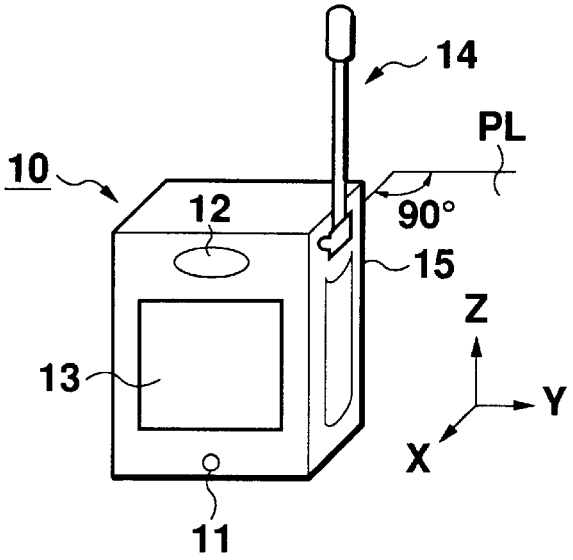
FIG. 13 is a perspective view of a portable information terminal employing an antenna device according to a fourth embodiment of the present invention.
Figure 14:
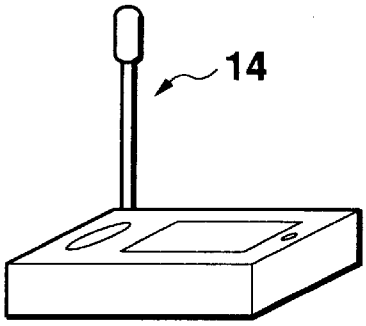
FIG. 14 illustrates the portable information terminal in use.
Figure 15:
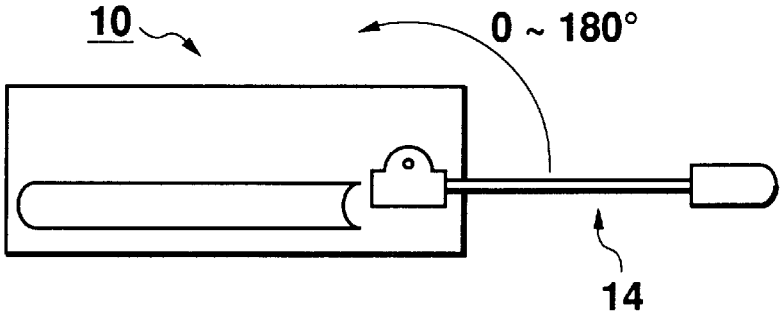
FIGS. 15 and 16 illustrate a rotation extent of the antenna assembly.
Figure 16:
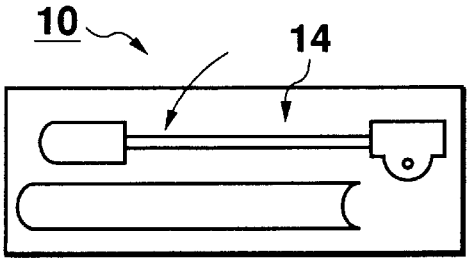

FIG. 13 illustrates an antenna device according to a fourth embodiment. The fourth embodiment is characterized in that the antenna assembly 14 can rotate within a plane perpendicular to the X-Y axes reference plane PL of the portable information terminal 10 at the extended position. When the portable information terminal 10 is placed on a desk or the like, as shown in FIG. 14, antenna efficiency can further be improved with respect to vertical polarization. In addition, the antenna assembly 14 can rotate in a range of 180 degrees as shown in FIGS. 15 and 16, so that the antenna device can be freely positioned. The identical reference numerals are attached to the elements having the same function as those in the previous embodiments.

Figure 17:
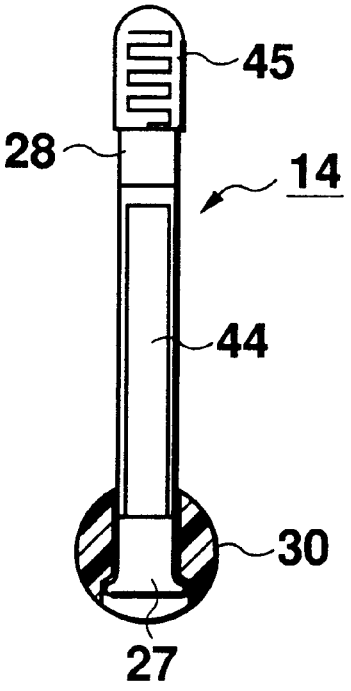
FIG. 17 illustrates a modified example of an antenna assembly.
Figure 18:
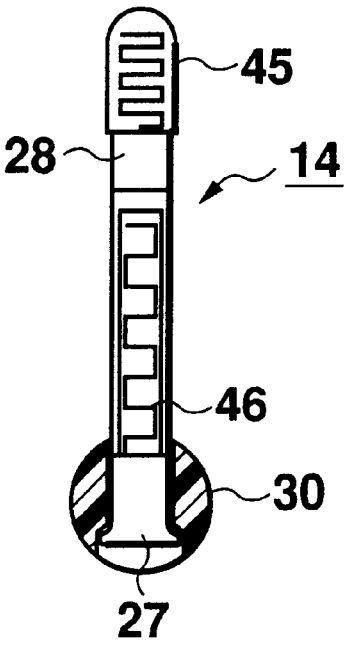
FIG. 18 illustrates another modified example of an antenna assembly.
Figure 19:
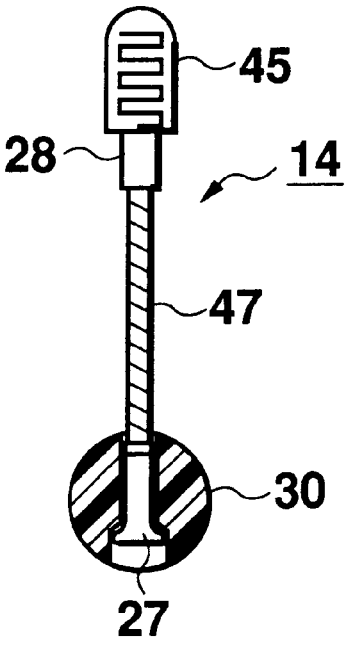
FIG. 19 illustrates still another modified example of an antenna assembly.

The previous embodiments generally employs an antenna assembly 14 comprising a whip antenna 20 as a first antenna and a helical antenna 21 as a second antenna. A planar antenna 44 and a meander line antenna 45 can be employed as shown in FIG. 17 in place of the respective whip and helical antennas. In this case, a meander line antenna 46 may be combined in place of the planar antenna 44, as shown in FIG. 18, and a helical antenna 47 may be combined in place of the planar antenna as shown in FIG. 19. The meander line antennas 45, 46 comprise a meander line wire formed on or embedded in a non-conductive panel member. The helical antenna 47 comprises a wire spirally wound around a non-conductive pole member. Employment of the planar antenna 44 or the meander line antennas 45, 46 enables an antenna assembly 14 to be reduced in thickness. Employment of the meander line antennas 45, 46 and the helical antenna 47 enables the reduction in height of the antenna assembly 14. Further, since the planar antenna 44 and a plate member of the meander line antennas 45, 46 are arranged along a plane on which the antenna assembly 14 moves, they have strength along such a plane so that rotating force applied to the antenna assembly 14 is smoothly transmitted to the rotator 30. In FIGS. 17 to 19, the first antenna likewise receives a signal through the first electrical feeder 27 while the second antenna likewise receives a signal through the second electrical feeder 28.

Figure 20:
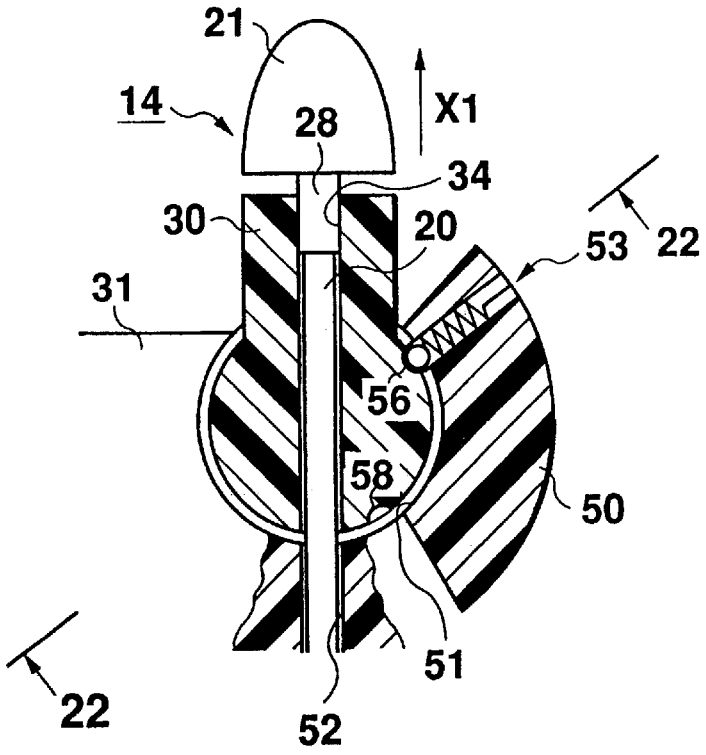
FIG. 20 illustrates an antenna device according to a fifth embodiment of the present invention.

FIG. 20 illustrates an antenna device according to a fifth embodiment of the present invention. The fifth embodiment is characterized in that the antenna device further comprises a withdrawal prevention piece for preventing the first antenna from withdrawing from the extended position when the first antenna rotates relative to the housing. The identical reference numerals are attached to the elements having the same function as those in the previous embodiments.

The withdrawal prevention piece 50 is integrally formed in the housing wall 31 so as to include a prevention surface 51 of a shape corresponding to the peripheral shape of the rotator 30. The antenna assembly 14 can displace between the extended position and the storage position at a reference position of the rotator 30 as shown in FIG. 20. When the antenna assembly 14 is pulled out in the withdrawal direction X1 until it is mostly removed from the storage hole 52 of the housing wall 31, the rotator 30 is brought into a rotatable state.

Figure 21:
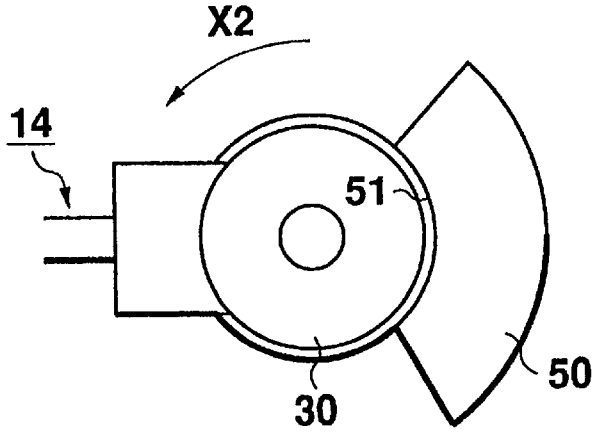
FIG. 21 illustrates a fixed position of the rotator.

When the antenna assembly 14 is pulled out to the extended position and rotated by means of the rotator 30, as shown in FIG. 21, the prevention surface 51 is opposed to the exit of the through hole 34 of the rotator 30. It is thus possible to prevent the first electrical feeder 27 of the whip antenna 20 from being completely removed out of the rotator 30, whereby electrical connection would be disconnected.

Figure 22:
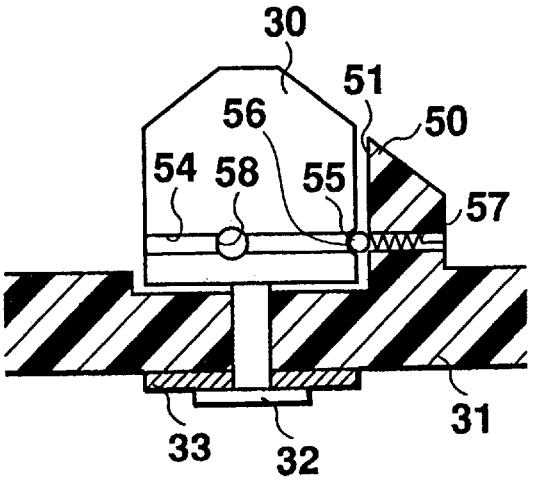
FIG. 22 illustrates a click mechanism for the rotator.

A click mechanism 53 may be provided between the withdrawal prevention piece 50 and the rotator 30 for temporarily holding the rotator 30. The click mechanism 53 comprises a guide slot 54 carved on the periphery of the rotator 30, and a ball 55 provided to the withdrawal prevention piece 50 for moving along the guide slot 54, as shown in FIG. 22. When the rotator 30 assumes the reference position, the ball 55 fits into a first recess 56 so that the rotator 30 is held at the reference position by the spring 57 biasing the ball 55. When the rotator 30 starts rotating in the direction X2, the ball 55 enters the guide slot 54 against the biasing force from the spring 57 so as to move along the guide slot 54. When the rotator 30 reaches a fixed position as shown in FIG. 21, the ball 55 fits into a second recess 58 so that the rotator 30 is held at the position by the biasing force from the spring 57. The antenna assembly 14 is prevented from moving when it assumes certain positions.

Figure 23:
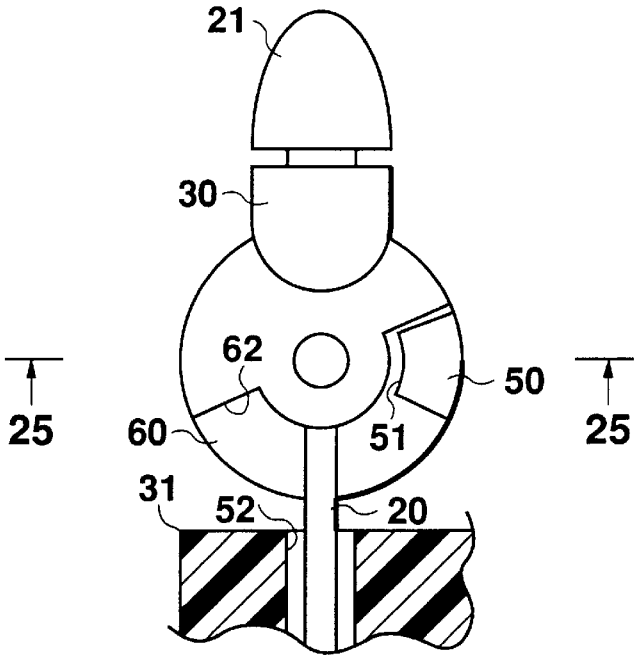
FIGS. 23 to 25 illustrate a modified example of the fifth embodiment.
Figure 24:
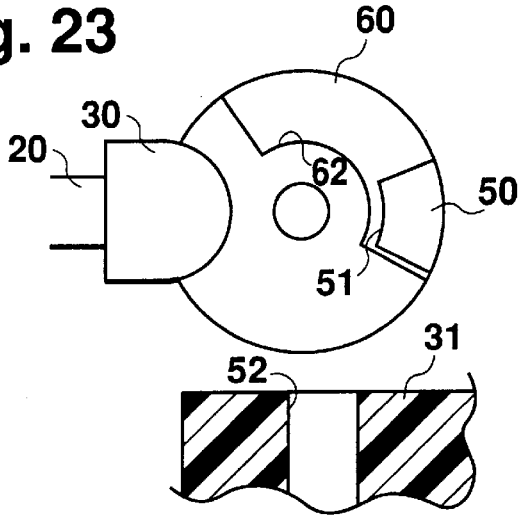
Figure 25:
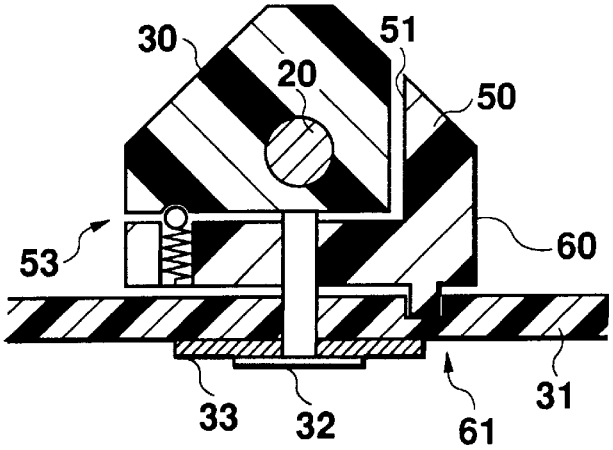

As shown in FIGS. 23 to 25, the withdrawal prevention piece 50 may be formed separately from the housing wall 31. The withdrawal prevention piece 50 projects from a planar receiving member 60 which receives the bottom of the rotator 30. Although the receiving member 60 is disposed around the shaft 32, the receiving member 60 is prevented from rotating about the shaft 32 by a rotation blocking mechanism 61 comprising a recess and a projection. The rotator 30 includes a notch 62 for receiving the withdrawal prevention piece 50 in the extent the withdrawal displaces. The movement of the rotator 30 is thus not hindered by the withdrawal prevention piece 50. Moreover, the contact of the withdrawal prevention piece 50 with opposite end surfaces of the notch 62 defines an extent of rotation of the rotator 30. The identical reference numerals are attached to elements having the same function as those shown in FIGS. 20 to 22.

Figure 26:
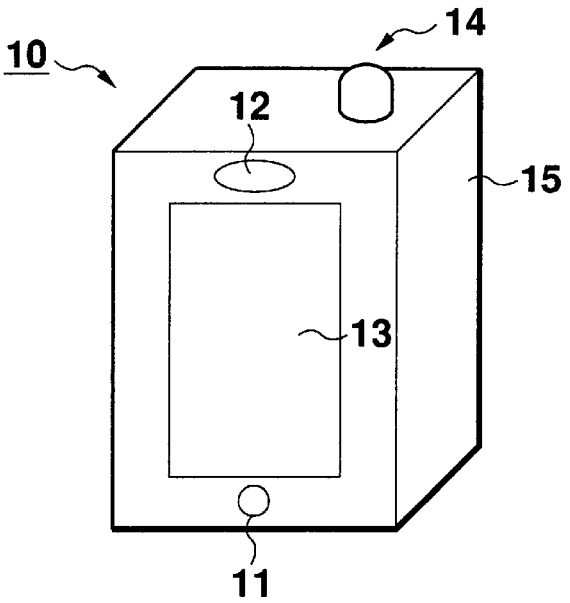
FIG. 26 is a perspective view of a portable information terminal employing an antenna device according to a sixth embodiment of the present invention.
Figure 27:
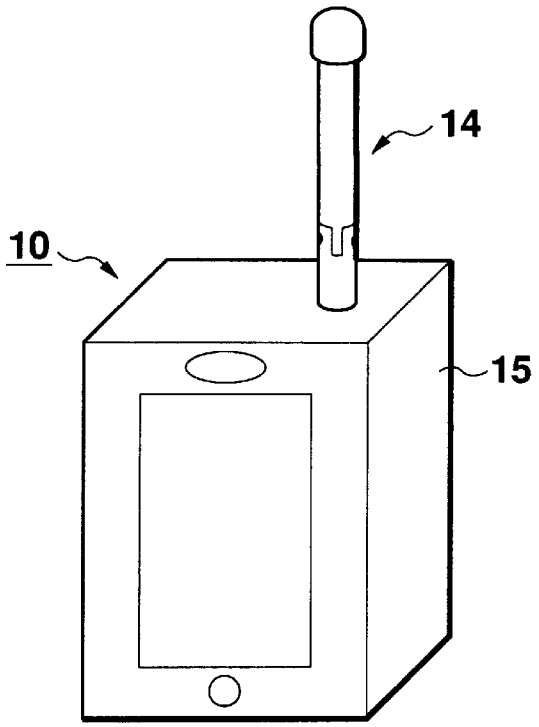
FIG. 27 is a perspective view of portable information terminal illustrating an extended position of the antenna assembly.
Figure 28:
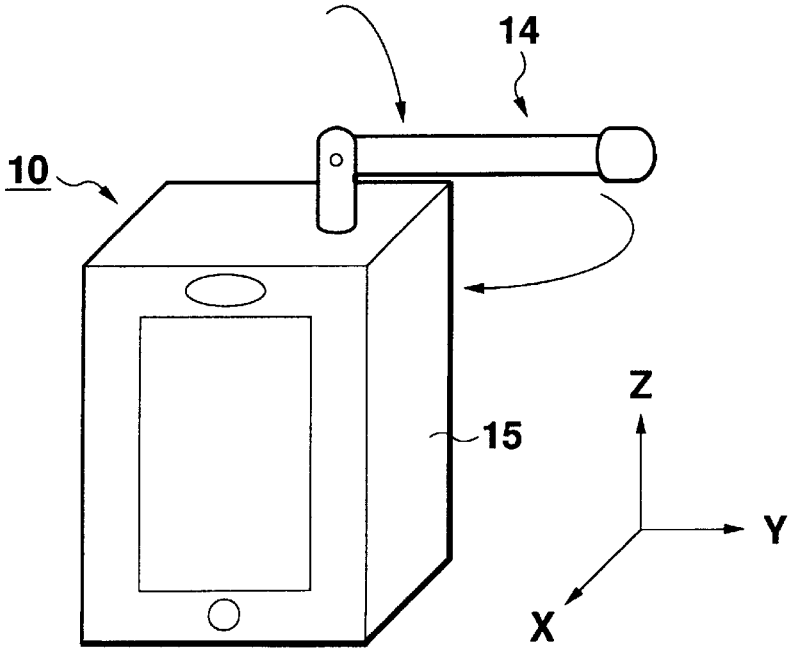
FIG. 28 is a perspective view of portable information terminal illustrating rotation of the antenna assembly.

FIG. 26 illustrates a portable information terminal 10 employing an antenna device according to a sixth embodiment of the present invention. The antenna assembly 14 of the portable information device 10 operates at a storage position where the antenna assembly 14 is contained within the housing 15 as shown in FIG. 26, and an extended position where the antenna assembly 14 is pulled out of the housing 15 as shown in FIG. 27. The antenna assembly 14 at the extended position as shown in FIG. 28 can bend and/or rotate so as to cause the tip thereof to trace a semi-sphere. The identical reference numerals are attached to elements having the same function as those in the foregoing embodiments.

Figure 29:
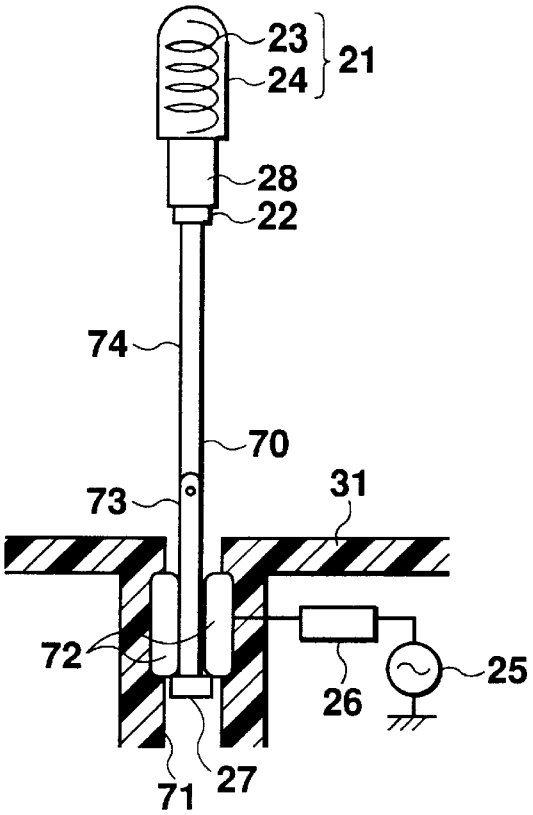
FIG. 29 is an enlarged sectional view illustrating the antenna device assuming the extended position.
Figure 30:
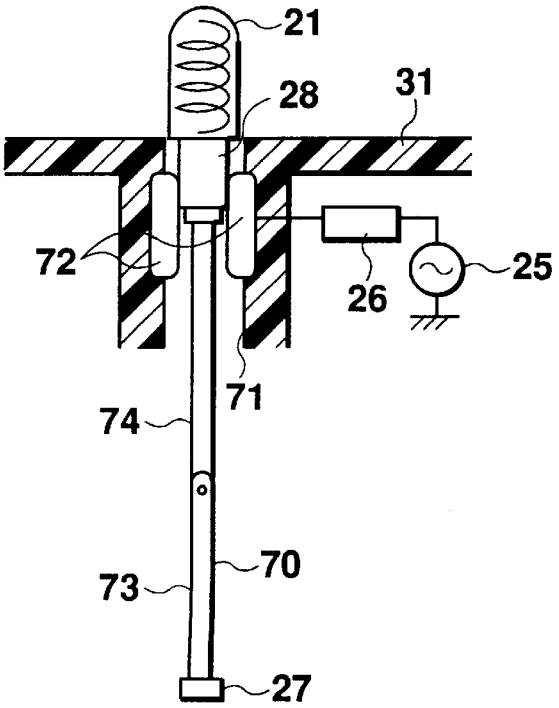
FIG. 30 is an enlarged sectional view illustrating the antenna device assuming the storage position.
Figure 32:
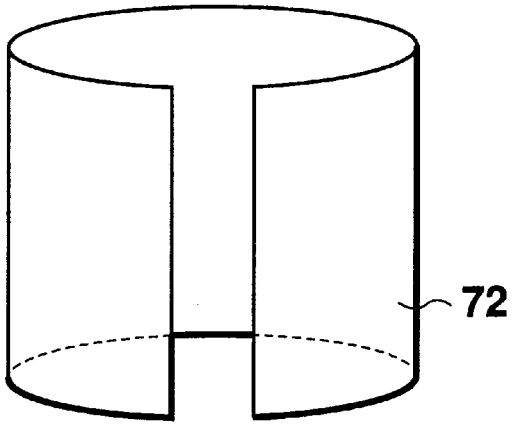
FIG. 32 illustrates an entire structure of a spring member.

Referring to FIGS. 29 to 30, the antenna assembly 14 comprises a whip antenna 70 having an electrical length of a half wavelength as a first antenna made from metallic material such as stainless, and a helical antenna 21 attached to the tip of the aforementioned whip antenna 20 (a second antenna). When the antenna assembly 14 assumes the extended position, as shown in FIG. 29, the whip antenna 70 is held at its base end by an elastic force of a spring member 72 (see FIG. 32) embedded in a storage hole 71 of the housing wall 31. The whip antenna 70 receives a high-frequency signal from the high-frequency signal source 25 through the first electrical feeder 27. When the antenna assembly 14 assumes the storage position, as shown in FIG. 30, the helical antenna 21 is held at its base end by the spring member 72. The helical antenna 21 receives a high-frequency signal from the high-frequency signal source 25 through the spring member 72.

Figure 31:
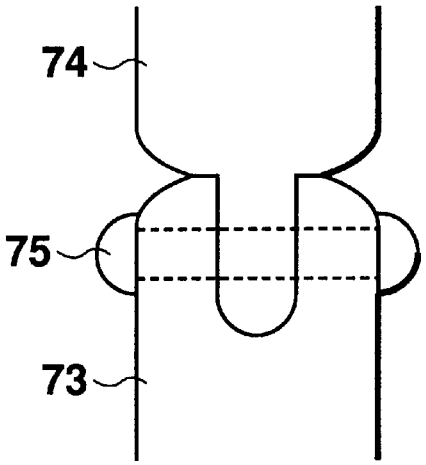
FIG. 31 is an enlarged view illustrating a connection between a support piece and a tip piece.

The whip antenna 70 comprises a support piece 73 supported by the housing wall 31 at the extended position, and a tip piece 74 connected to the support piece 73 for swinging movement for supporting the helical antenna 21. As is apparent from FIG. 31, the support piece 73 and the tip piece 74 are connected to each other with an axis 75, so that the tip piece 74 can swing in a range of 180 degrees.

With the above arrangement, the antenna assembly 14 can match to a polarization plane of radio wave from a base station without using a rotator required in the preceding embodiments, which allows a simplified structure and reduced volume.

Figure 33:
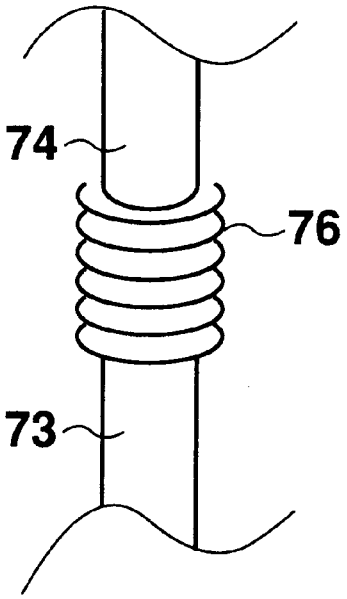
FIG. 33 illustrates a modified example of the whip antenna.
Figure 34:
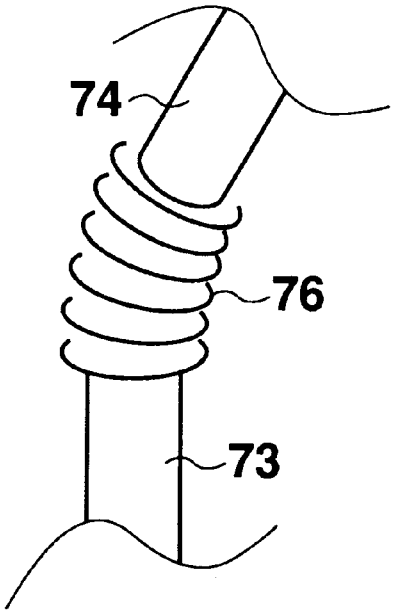
FIG. 34 illustrates a bent condition of the whip antenna.
Figure 35:
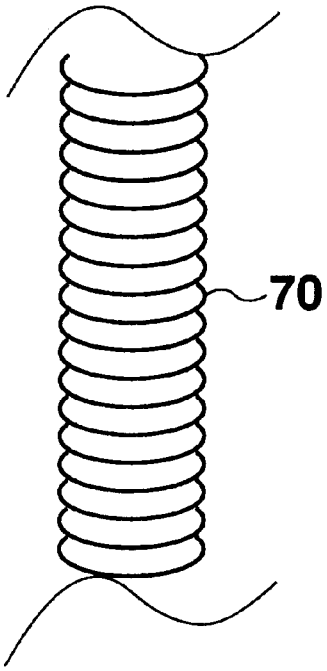
FIG. 35 illustrates another modified example of the whip antenna.
Figure 36:
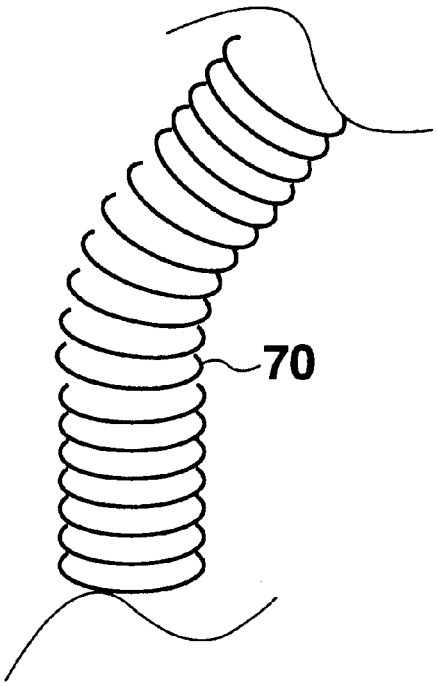
FIG. 36 illustrates a bent condition of the whip antenna.

A flexible arm 76 can be employed in place of the axis 75 between the support piece 73 and the tip piece 74 as shown in FIGS. 33 and 34. Since a flexible arm has sufficient significant elasticity to resist a strong impact, the whip antenna 70 is unlikely to be broken. Additionally, the whip antenna 70 can be smoothly rotated and bent, leading to facilitated handling. If the whip antenna 70 is entirely comprised of a flexible arm, as shown in FIGS. 35 and 36, the whip antenna 70 can be bent to a desired position.

Figure 37:
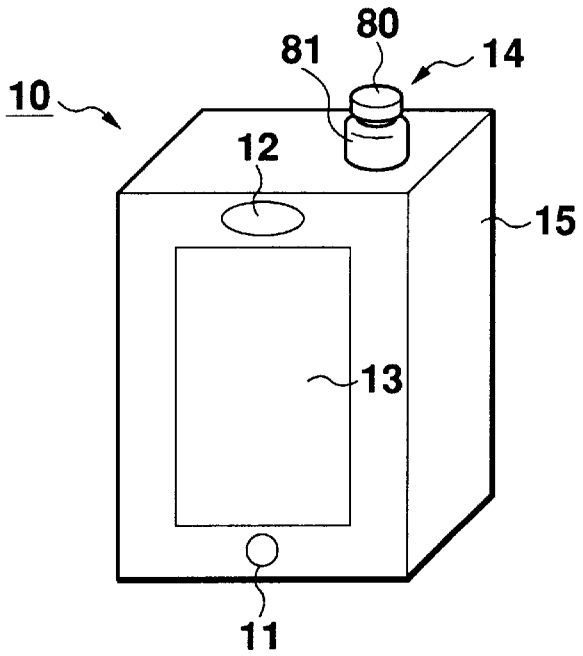
FIG. 37 is a perspective view of a portable information terminal employing an antenna device according to a seventh embodiment of the present invention.
Figure 38:
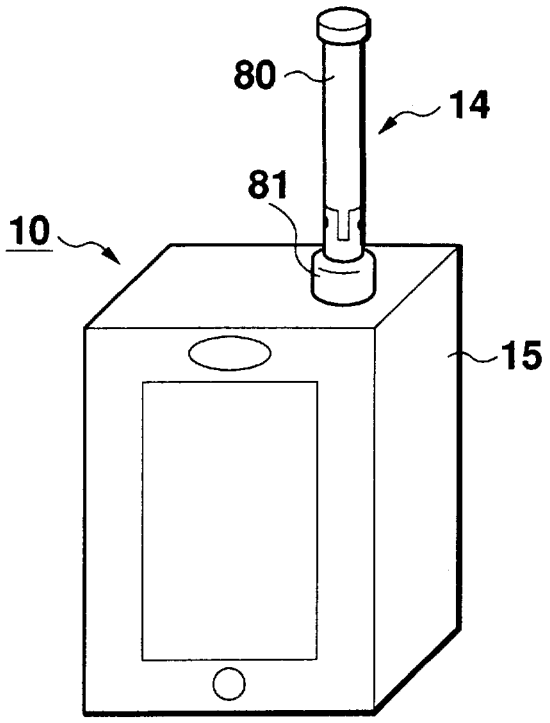
FIG. 38 is a perspective view of the portable information terminal illustrating an extended position of the antenna assembly.
Figure 39:
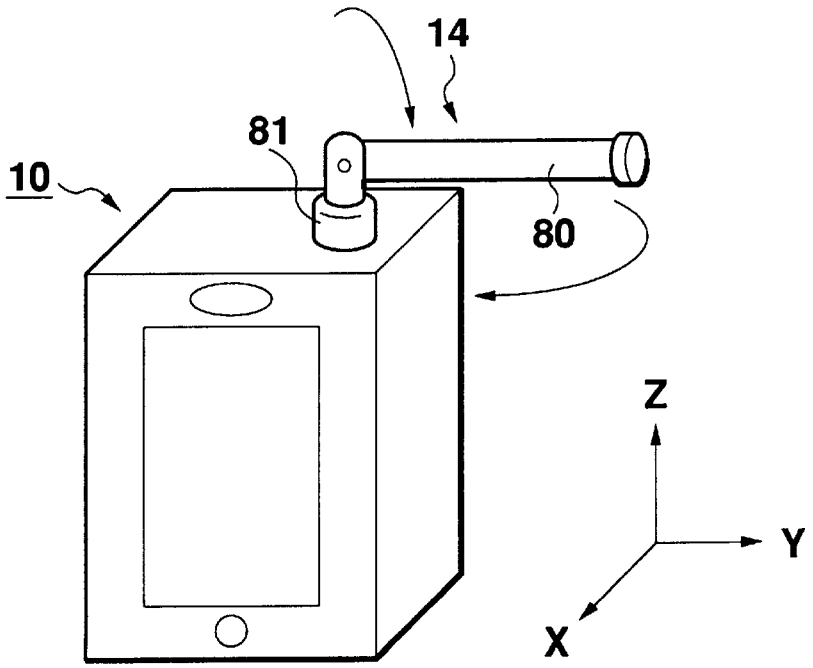
FIG. 39 is a perspective view of the portable information terminal illustrating rotation of the antenna assembly.

FIG. 37 illustrates a portable information terminal 10 employing an antenna device according to a seventh embodiment of the present invention. Referring also to FIG. 38, the antenna assembly 14 of the portable information terminal 10 comprises a whip antenna 80 as a first antenna capable of moving between a storage position where the whip antenna 80 is contained within the housing 15, and an extended position where the antenna 80 is pulled out of the housing 15 for receiving and/or transmitting a signal; and a helical antenna 81 as a second antenna attached to an external surface of the housing 15 for surrounding the whip antenna 80. The helical antenna 81 transmits and receives a signal when the whip antenna 80 assumes the storage position. The antenna assembly 14 can rotate and/or bend at the extended position, similar to the preceding embodiments, so as to cause the tip of the antenna assembly 14 to trace a semi-sphere as shown in FIG. 39. With this arrangement, since the helical antenna 81 is fixed to the housing 15, the weight of the tip or the volume of the whip antenna 81 can be reduced, thereby enhancing mechanical strength of the antenna assembly 14. The identical reference numerals are attached to the elements having the same function as those in the foregoing embodiments.

Figure 40:
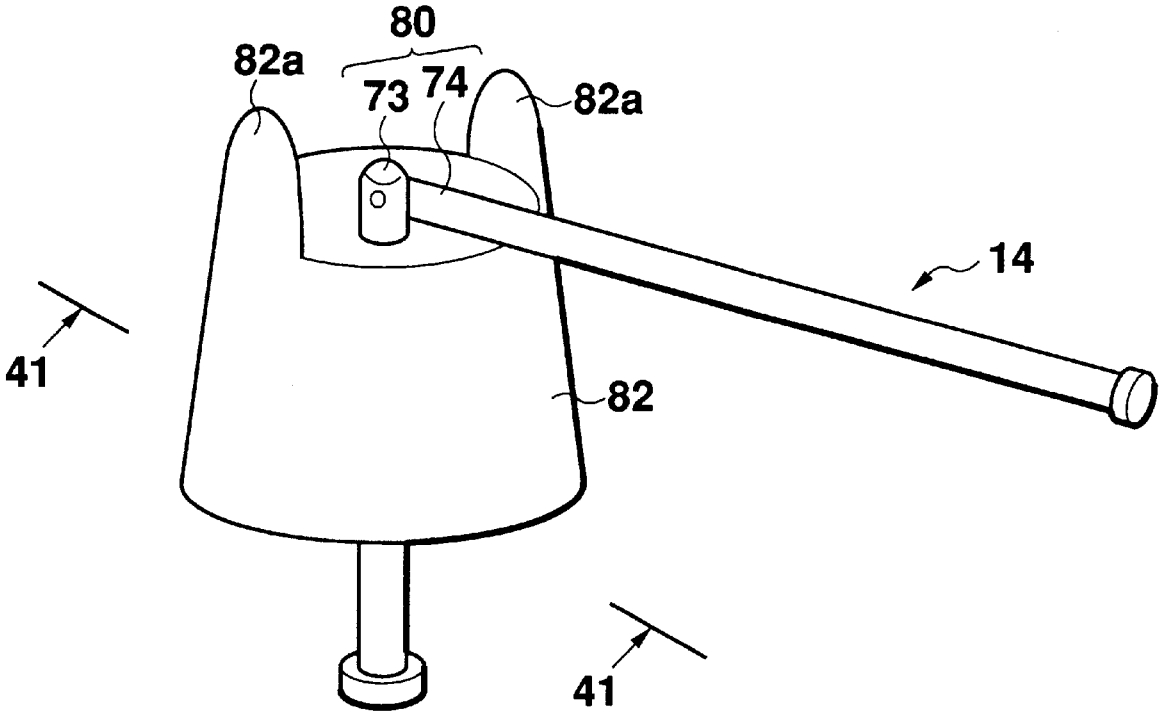
FIG. 40 illustrates an elastic member for the helical antenna.
Figure 41:
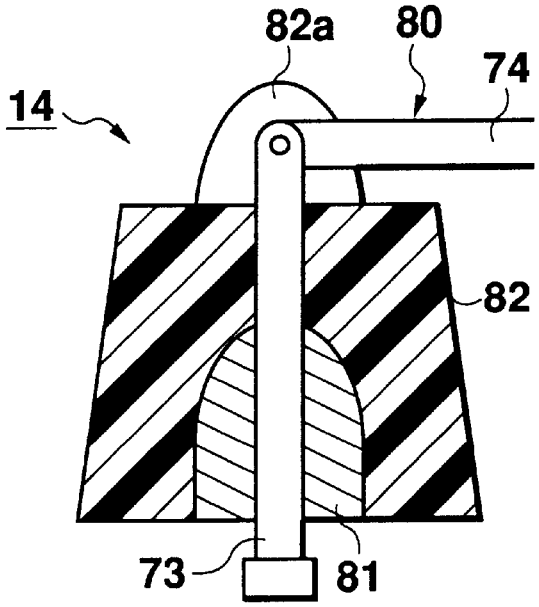
FIG. 41 is a sectional view of the elastic member.

The helical antenna 81 fixed to the equipment 15 can be covered by an elastic member 82 such as rubber or soft resin as shown in FIG. 40. The elastic member 82 may reduce any external force applied to the helical antenna 81. Referring also to FIG. 41, a protection piece 82*a* may be provided to the elastic member 82 so that the connection between the support piece 73 and the tip piece 74 is protected from impact should the portable information terminal 10 be dropped.

Figure 42B:
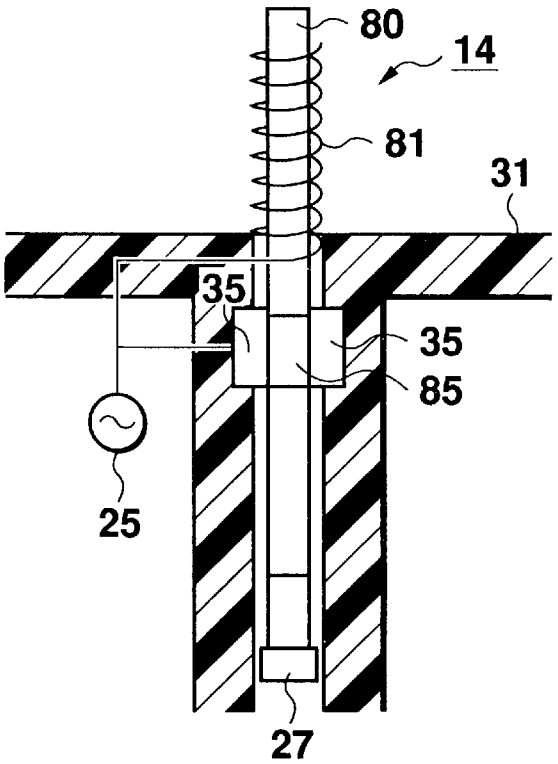
FIGS. 42A and 42B illustrate a method of supplying a signal to the whip and helical antennas.
Figure 42A:
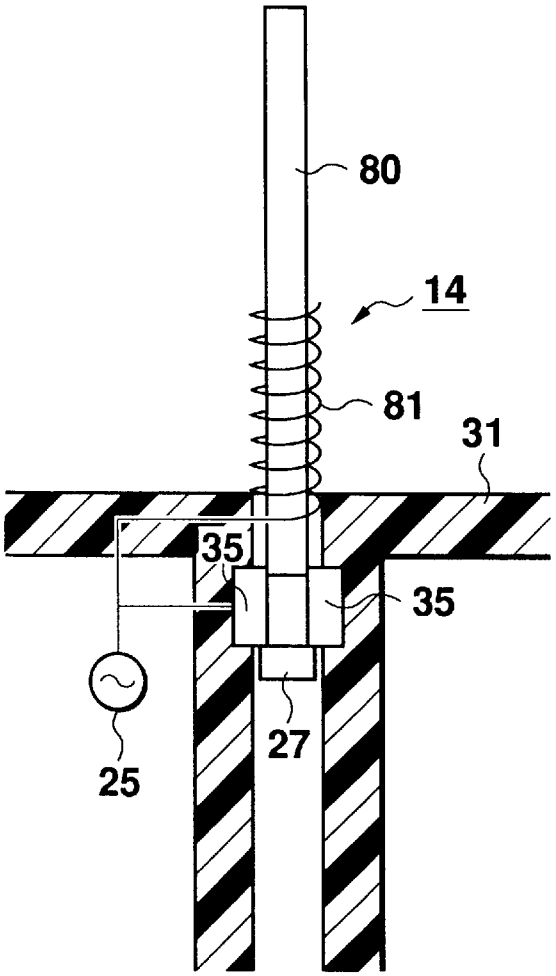

In the seventh embodiment, a signal may be supplied to both the whip and helical antennas 80, 81 at both the extended and storage positions as shown in FIGS. 42A and 42B. When the antenna assembly 14 assumes the extended position, as shown in FIG. 42A, the helical antenna 81 receives a high-frequency signal directly from the high-frequency signal source 25 while the whip antenna 80 receives a high-frequency signal through the spring member 35 and the first electrical feeder 27. When the antenna assembly 14 assumes the storage position, as shown in FIG. 42B, the helical antenna 81 receives a high-frequency signal directly from the high-frequency signal source 25 while the whip antenna 80 receives a high-frequency signal through the spring member 35 and the second electrical feeder 85. The adjustment of length of the whip antenna 80 protruding from the housing wall 31 at the extended position of the antenna assembly 14 enables exclusion of the effect from a fed signal to the whip antenna 80. In addition, the adjustment of length of the whip antenna 80 within the housing 15 at the storage position of the antenna assembly 14 enables exclusion of the effect from a fed signal to the whip antenna 80, thereby leading to a superior irradiation pattern.

Figure 43B:
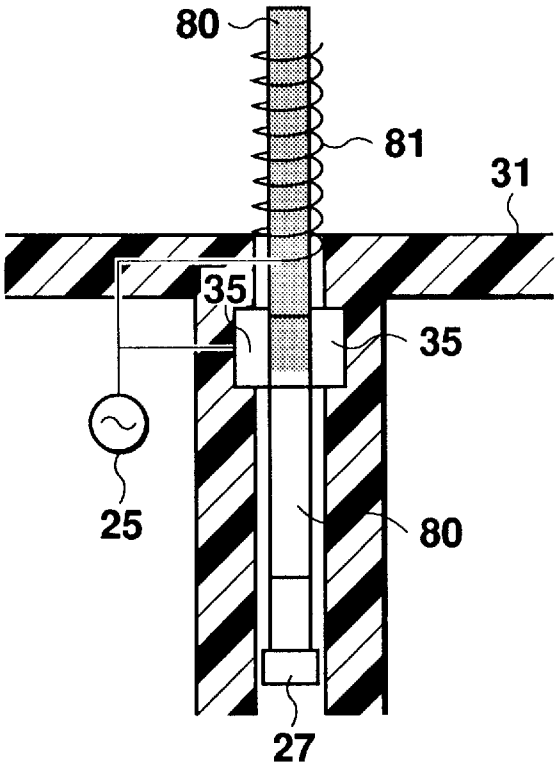
FIGS. 43A and 43B illustrate another method of supplying a signal to the whip and helical antennas.
Figure 43A:
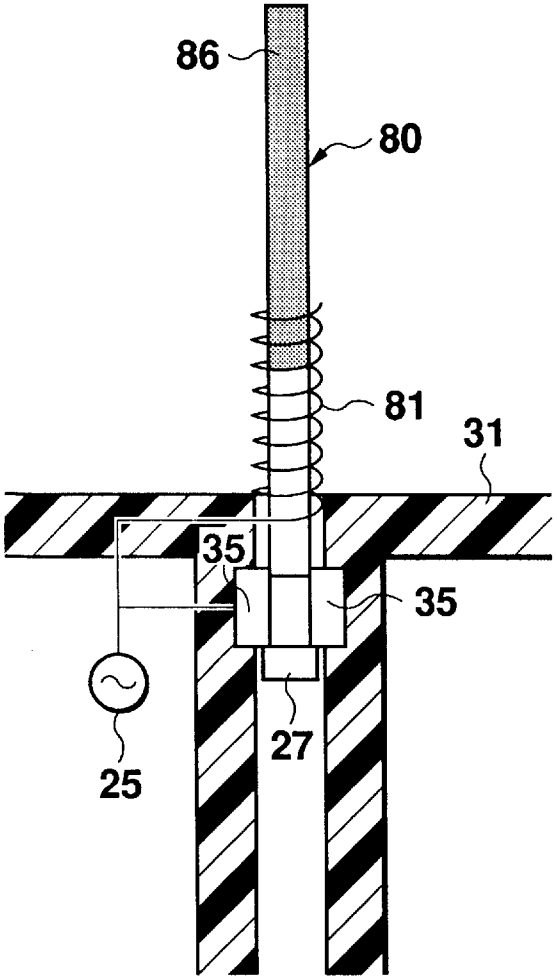

In this seventh embodiment, a signal may be supplied to both the whip and helical antennas 80, 81 at the extended position of the antenna assembly 14 while a signal may be supplied only to the helical antenna 81 at the storage position as shown in FIGS. 43A and 43B. Specifically, the whip antenna 80 is provided with an insulator 86. When the antenna assembly 14 assumes the extended position, as shown in FIG. 43A, the helical antenna 81 receives a high-frequency signal directly from the high-frequency signal source 25 while the whip antenna 80 receives a high-frequency signal through the spring member 35 and the first electrical feeder 27. When the antenna assembly 14 assumes the storage position, as shown in FIG. 43B, the helical antenna 81 receives a high-frequency signal directly from the high-frequency signal source 25. On the other hand, the whip antenna 80 does not receive a high-frequency signal since the spring member 35 contacts against the insulator 86. As a result, the helical antenna 81 achieves a superior irradiation pattern at the storage position without the effect of the whip antenna 80. However, it should be noted that the antenna assembly 14 may be longer by the amount of length of the insulator 86 as compared with the example shown in FIGS. 42A and 42B.

Further, the whip antenna 80 may receive a signal without the first and second electrical feeder 27, 85 in this seventh embodiment since the whip antenna 80 is surrounded by the helical antenna 81 at the storage position of the antenna assembly 14. Specifically, when the helical antenna 81 irradiates radio waves in the condition shown in FIGS. 42B and 43B, an electrical current is induced in the whip antenna 80 so that both the whip and helical antennas 80, 81 irradiate radio waves. Any operational difference cannot be observed even when the above method of supplying a signal to the whip antenna 80 is employed.

Figure 44:
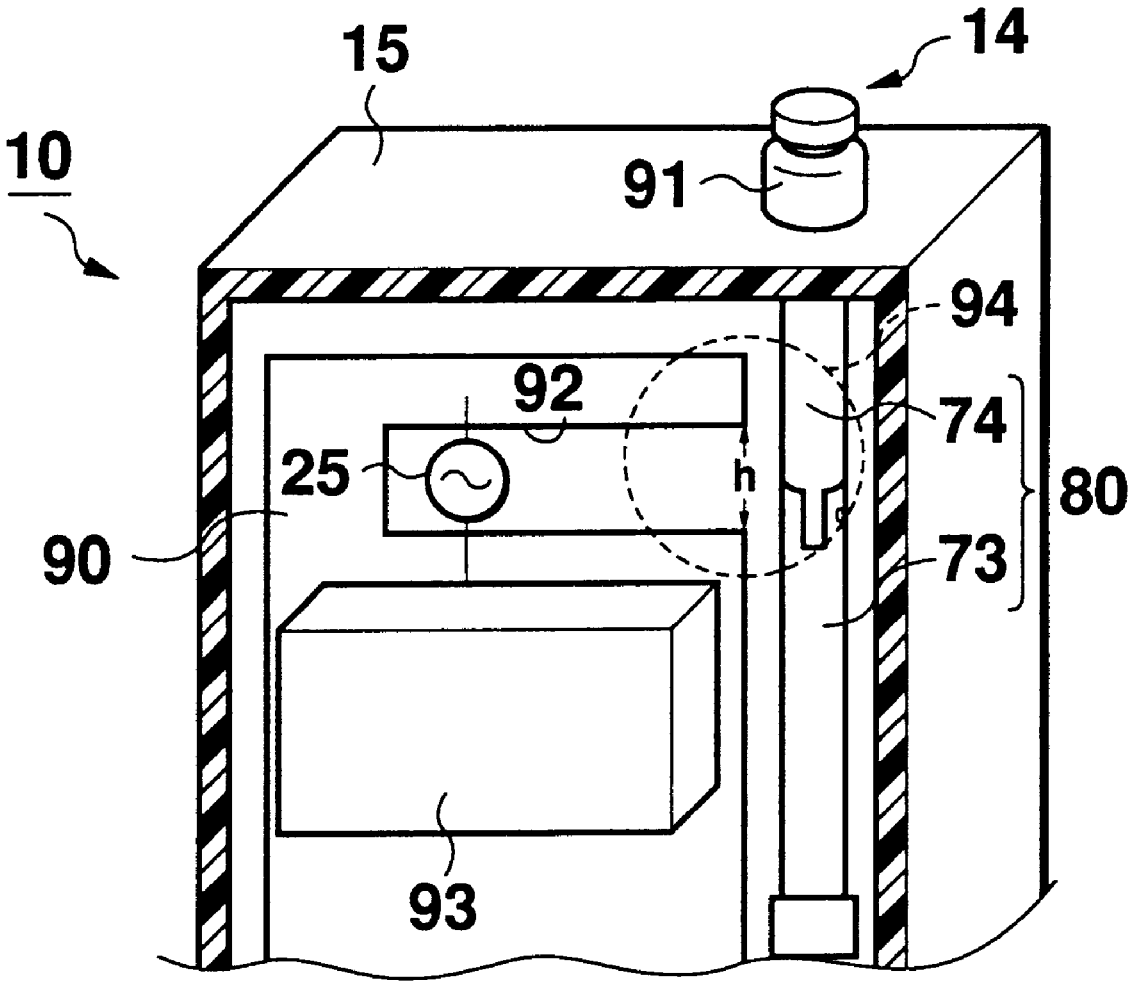
FIG. 44 is a perspective view of a portable information terminal employing an antenna device according to an eighth embodiment of the present invention.

FIG. 44 illustrates a portable information terminal 10 employing an antenna device according to an eighth embodiment of the present invention. The eighth embodiment is characterized in that the antenna device comprises a first antenna capable of moving between a storage position and an extended position, and a second antenna disposed within the housing for magnetoelectrically coupling with the first antenna. The identical reference numerals are attached to elements having the same functions as those in the previous embodiments.

Specifically, the antenna device of the eighth embodiment comprises a whip antenna 80 as the first antenna and a notch antenna 90 as the second antenna. As is apparent from FIG. 44, the tip of the whip antenna 80 at the storage position protrudes from a surface of the housing 15 by means of an elastic piece 91 serving as a support means attached to a surface of the housing 15.

The notch antenna 90 comprises an opening 92 of an antenna height or opening width h opposed to the whip antenna 80 at both the storage and an extended positions as shown in FIG. 44. The opening 92 is positioned offset from a metallic member such as a shield metallic box 93 for containing an inner circuit substrate.

A high-frequency signal is supplied to the notch antenna 90 from the high-frequency signal source 25 at the storage position shown in FIG. 44. The notch antenna forms an electromagnetic connection 94 with the whip antenna 80 in the vicinity of the opening 92. As a result, an electrical current is induced in the whip antenna 80, so that the whip antenna 80 radiates radio waves. Sufficient antenna height of the notch antenna 90 allows a sufficient irradiation efficiency even when the whip antenna 80 is contained within the housing 15. Further, the notch antenna 90 is usually matched to an impedance of 50 ohms so that a matching circuit can be omitted. A slight difference between impedance of the notch and whip antenna 90, 80 can be adjusted by controlling the lengths of these notch and whip antennas.

Figure 45:
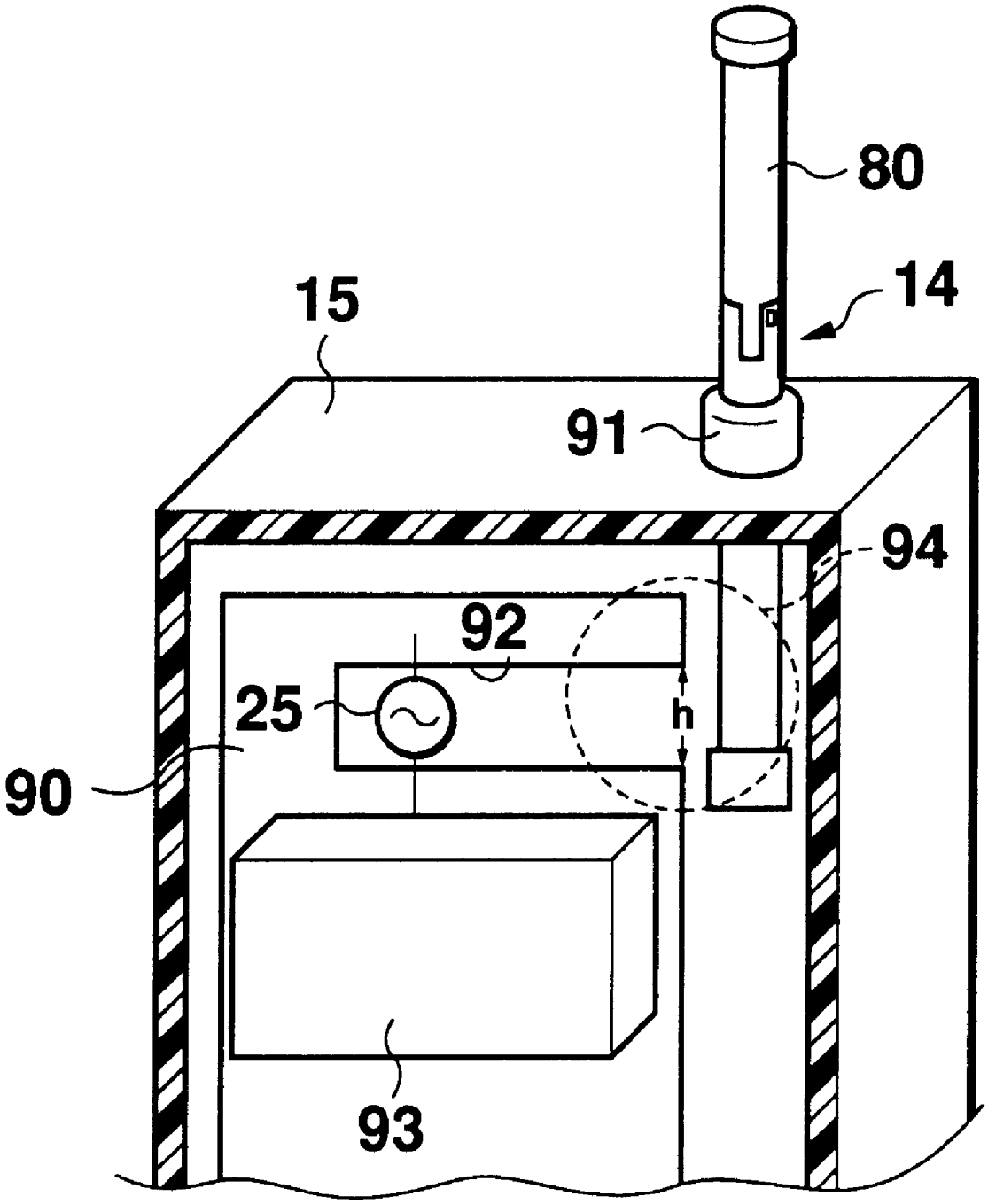
FIG. 45 is a perspective view of the portable information terminal illustrating an extended position of the antenna assembly.
Figure 46:
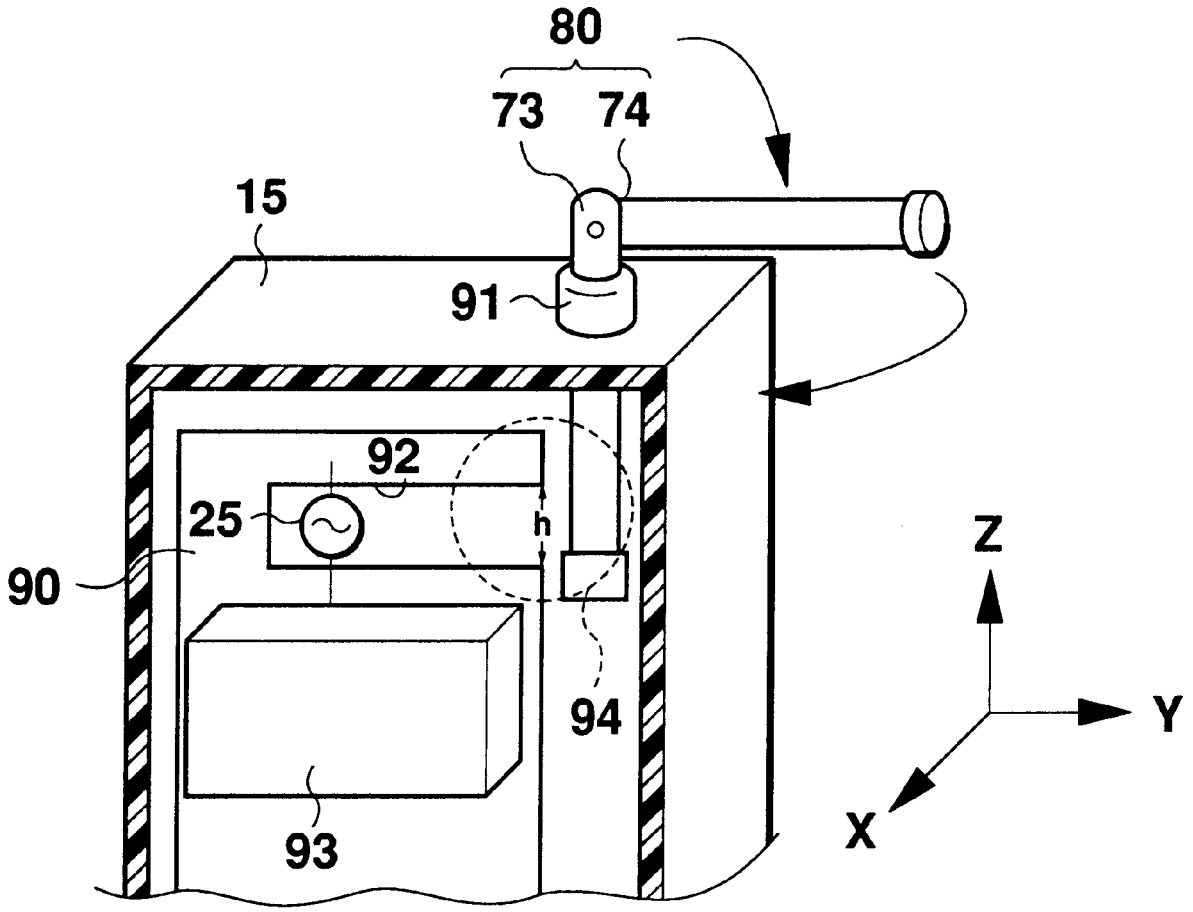
FIG. 46 is a perspective view of the portable information terminal illustrating rotation of the antenna assembly.

A high-frequency signal is supplied to the whip antenna 80 through the electromagnetic connection 94 of the notch antenna 90 at the extended position shown in FIG. 45 similar to the previous description. The whip antenna 80 comprising the support and tip pieces 73, 74 can likewise rotate and/or bend at the extended position as shown in FIG. 46.

Figure 47:
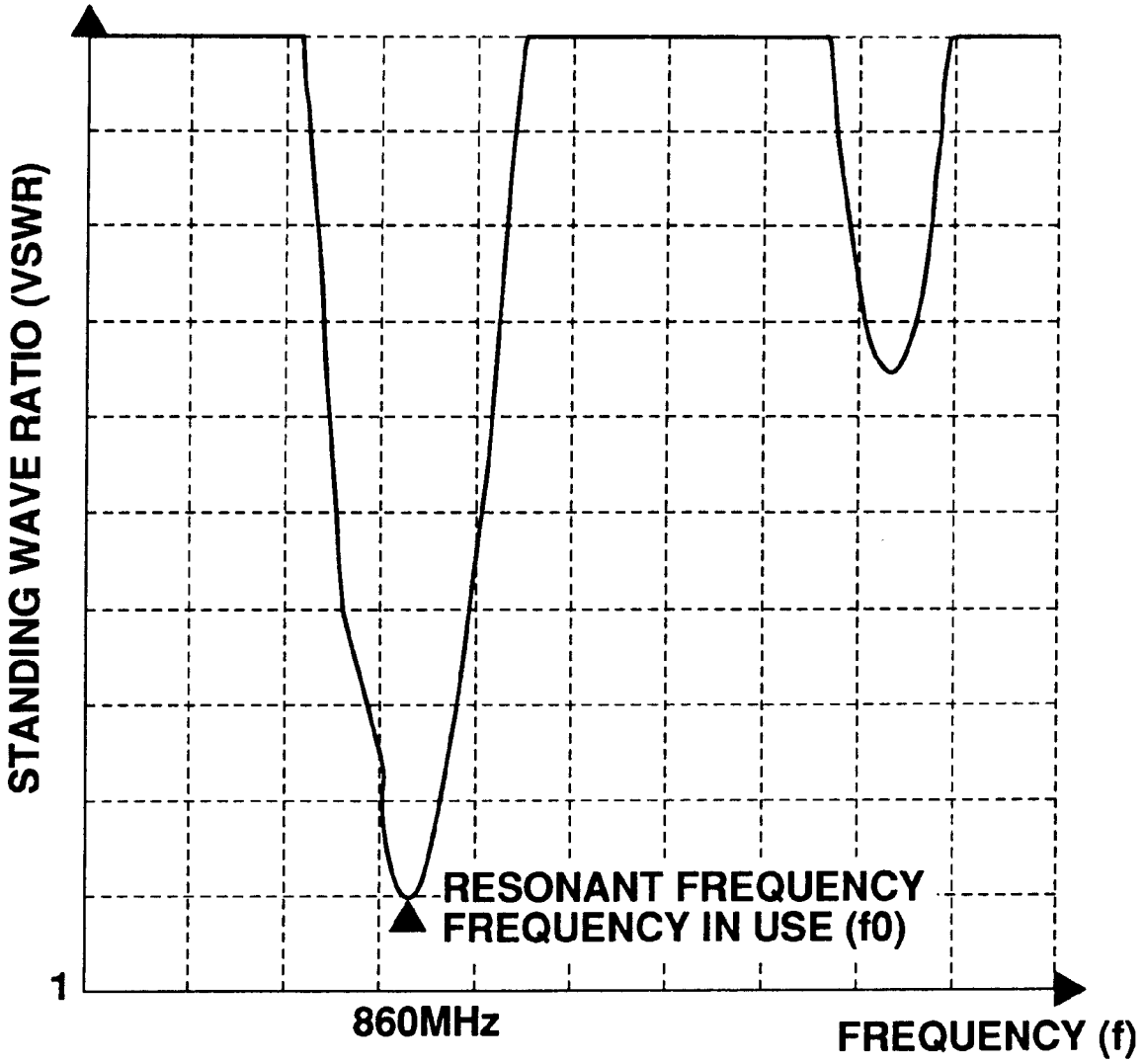
FIG. 47 illustrates a frequency characteristic of the antenna device at the storage position.
Figure 48:
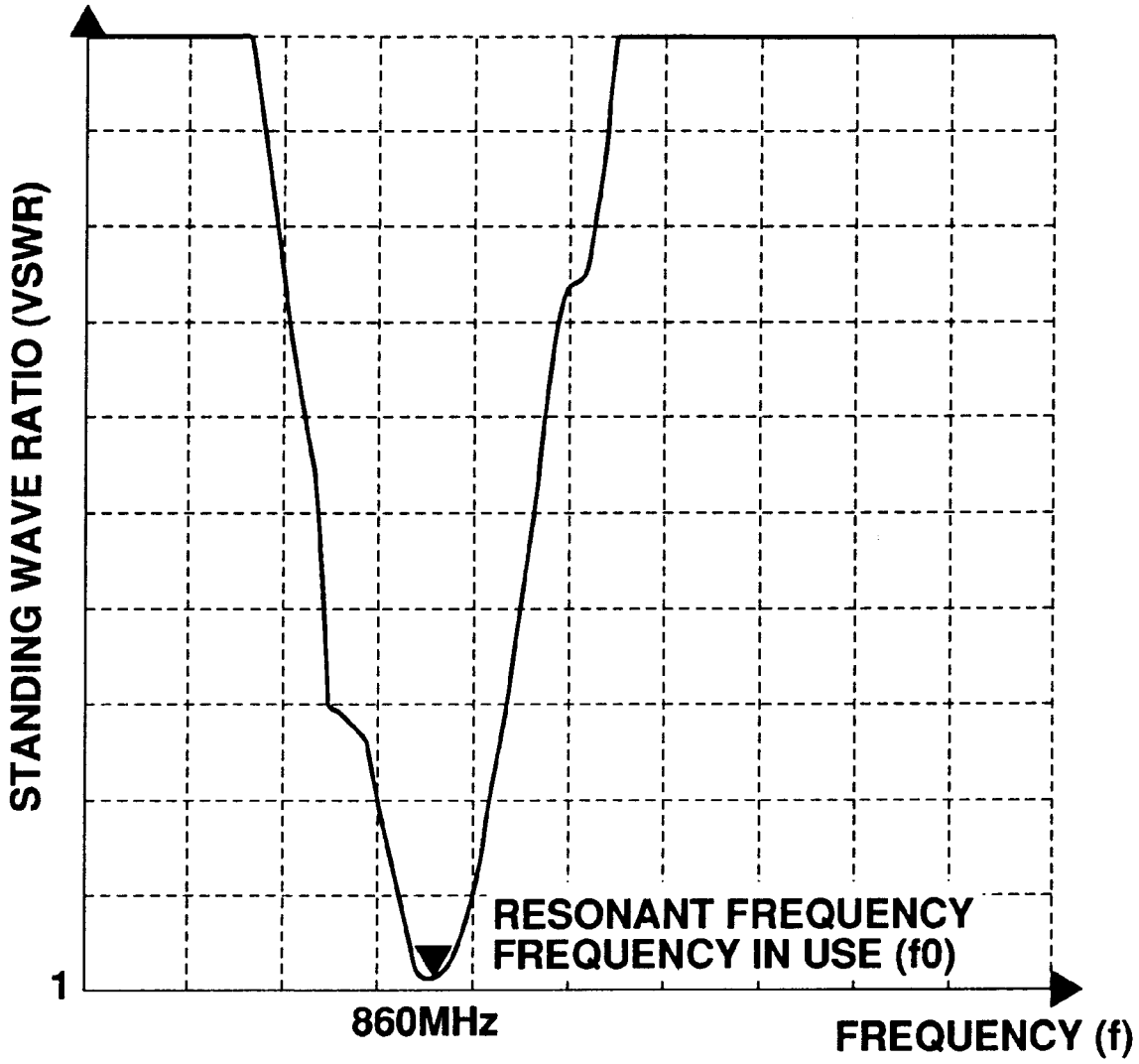
FIG. 48 illustrates a frequency characteristic of the antenna device at the extended position.

FIGS. 47 and 48 illustrate the result of an experiment for the antenna device according to the eighth embodiment. It can be observed that there is less difference between resonance points of the antenna device at the storage position (FIG. 47) and the extended position (FIG. 48) so that a common matching circuit can be employed. Specifically, a matched impedance for the notch antenna 90 allows omission of a matching circuit. It has been proved that the whip antenna 80 may achieve a sufficient irradiation with the tip protruding from the surface of the housing 15 by an amount of 20 to 25 mm.

As described above, the eighth embodiment allows a simplified structure with omission of a matching circuit, a helical antenna and a rotator, thereby contributing to reduction of cost. A signal is supplied to the whip antenna 80 by a non-contact connection such as an electromagnetic connection so that the structure of the whip antenna can be simplified, thereby contributing to reduction of cost. Further, the notch antenna 90 can be disposed within the housing 15, so that mobility of the portable information terminal 10 can be improved and design variation can be widened.

Figure 49:
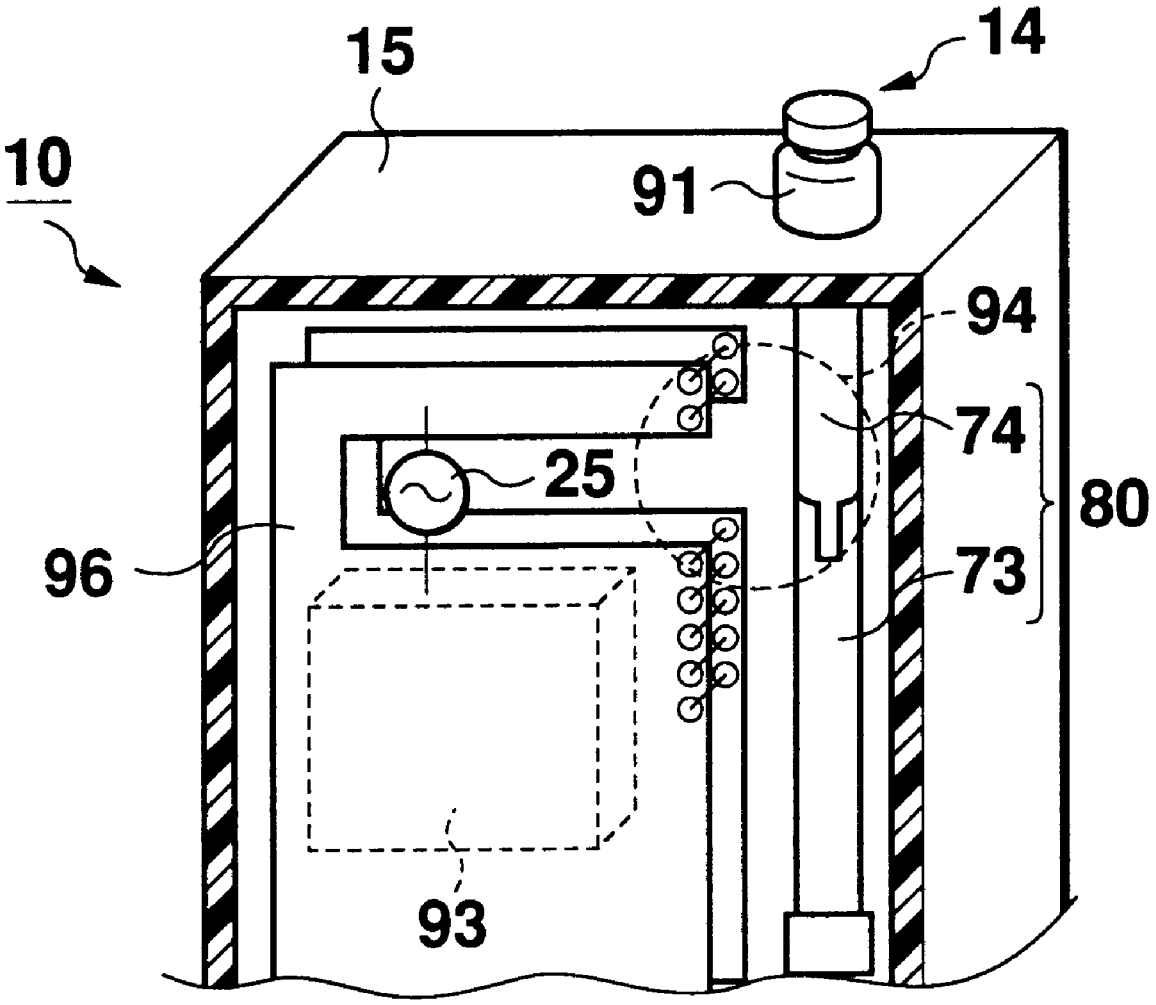
FIGS. 49 to 51 illustrate a modified example of the eighth embodiment.
Figure 50:
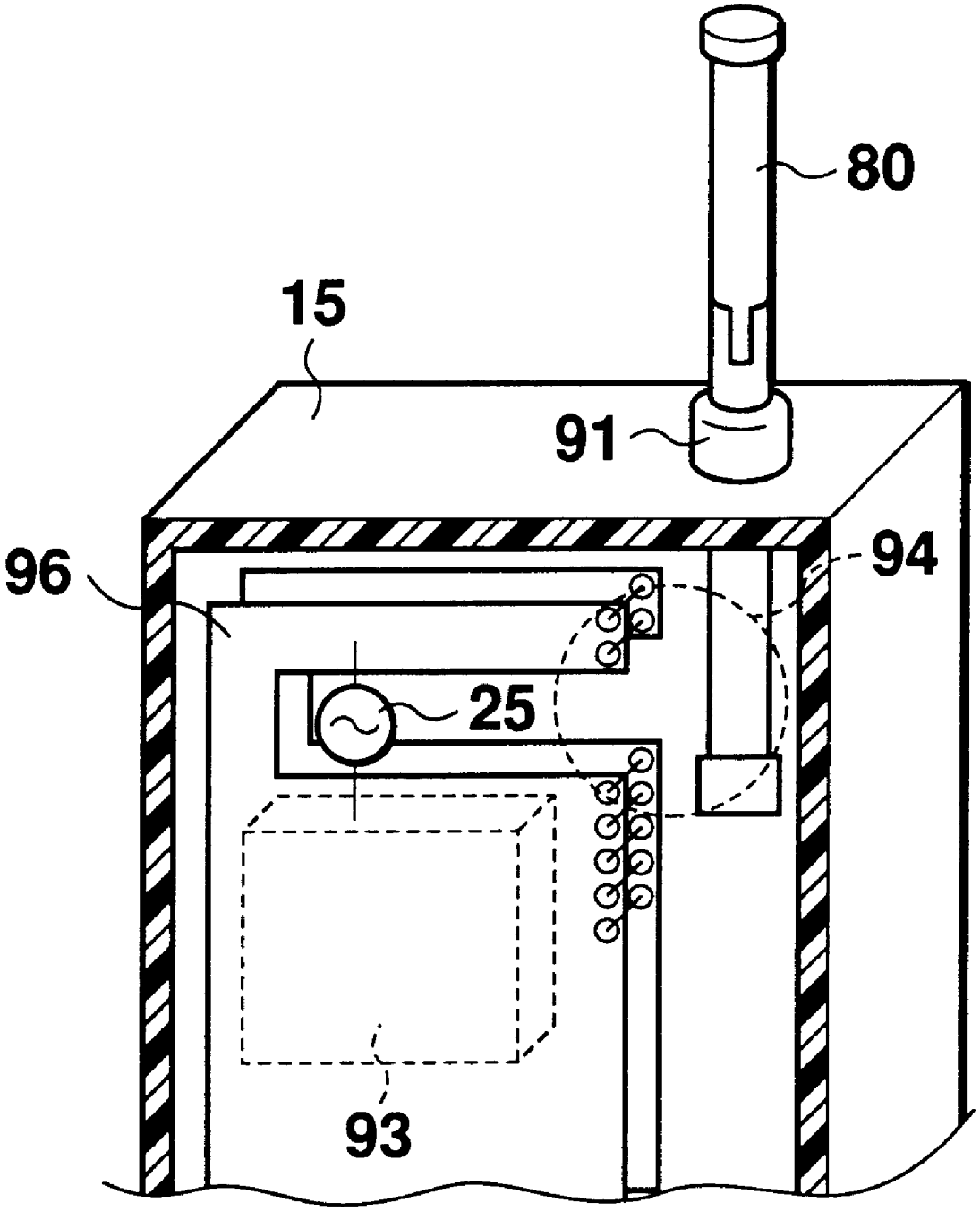
Figure 51:
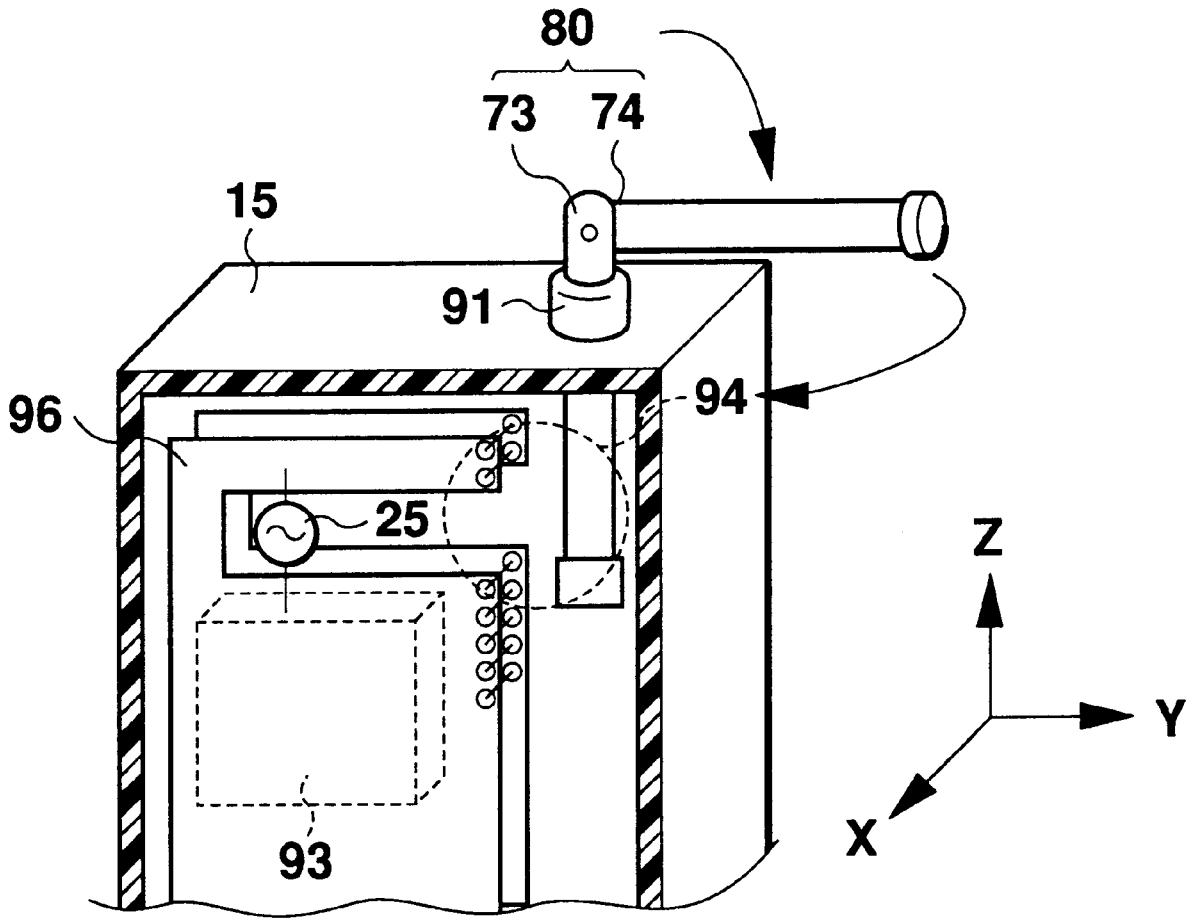
Figure 52:
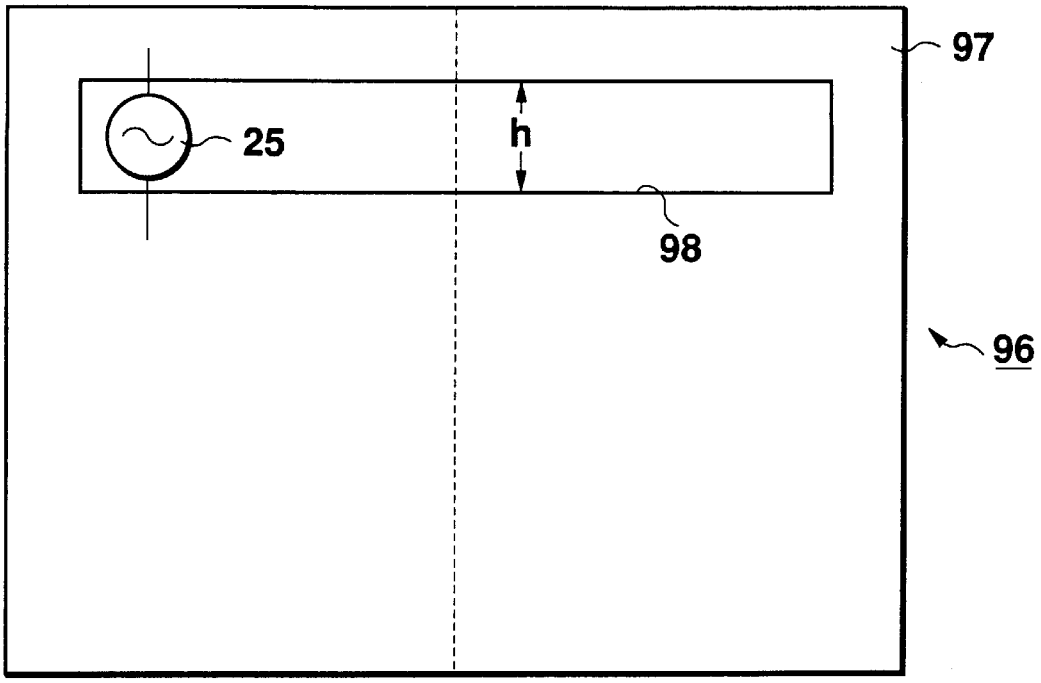
FIG. 52 is a developed plan view of a slot antenna.
Figure 53:
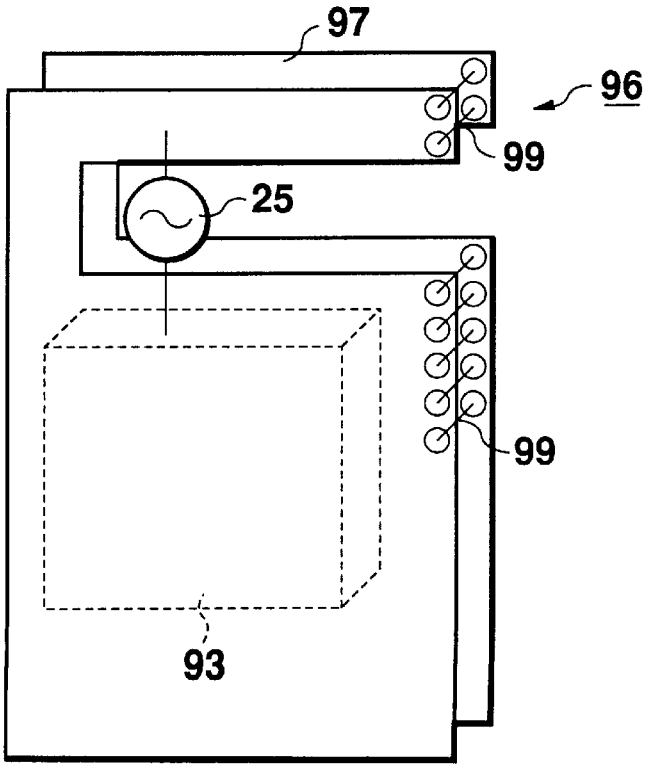
FIG. 53 illustrates the slot antenna in a form contained in the housing.

The antenna device of the eighth embodiment may employ a slot antenna 96 in place of the aforementioned notch antenna 90 as shown in FIGS. 49 to 51. The slot antenna 96 comprises a conductive plate 97 having a slot 98 of height h as shown in FIG. 52. When the slot antenna 96 is contained within the housing 15 of the portable information terminal 10, the conducive plate 97 may be folded or separated into two pieces as shown in FIG. 53 with respect to the center line. In the latter case, conductive lines 99 may be formed between the opposed pieces. In either cases, the conductive plate 97 only occupies a half of the volume as compared with the original one. The shield metallic box 93 may be disposed between the opposed pieces 97 for containing an inner circuit substrate. Since the slot antenna generally have a frequency band wider than the notch antenna so that it is easy to match an impedance of the slot antenna.

Figure 54:
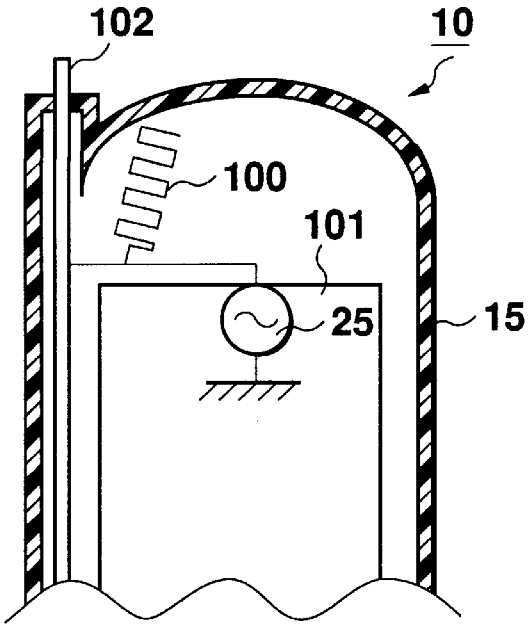
FIGS. 54 to 56 are perspective views of a portable information antenna employing an antenna device according to a ninth embodiment of the present invention.
Figure 55:
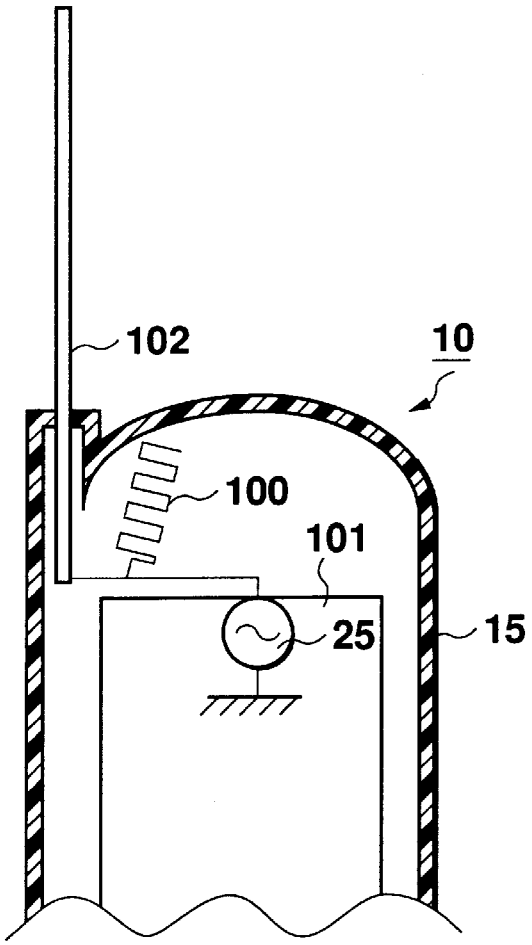
Figure 56:
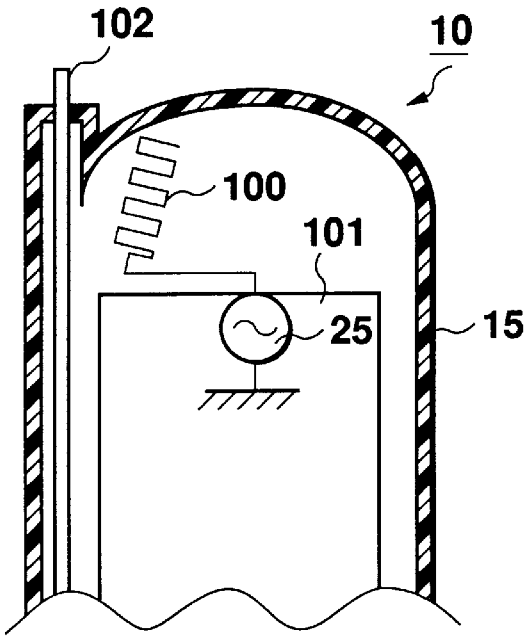

FIGS. 54 to 56 illustrate a portable information terminal 10 employing an antenna device according to a ninth embodiment of the present invention. The ninth embodiment is characterized in that a helical antenna as a second antenna is disposed within the housing 15 of the portable information terminal 10. The helical antenna 100 is arranged in a space between the metallic inner circuit substrate 101 and the inner surface of the housing 15. This structure enables a simplified structure of the helical antenna 100 since the helical antenna 100 is protected within the housing 15. Further, the helical antenna 100 can be hidden in the inner space so that the portable information terminal 10 achieves a simplified appearance. The meander line antenna 102 as a first antenna receives a signal from the high-frequency signal source 25 at the extended position as shown in FIG. 55 or at the storage position shown in FIG. 54. The meander line antenna 102 may not receive a signal at the storage position as shown in FIG. 56. The identical reference numerals are attached to elements having the same functions as those in the previous embodiments.

Figure 57:
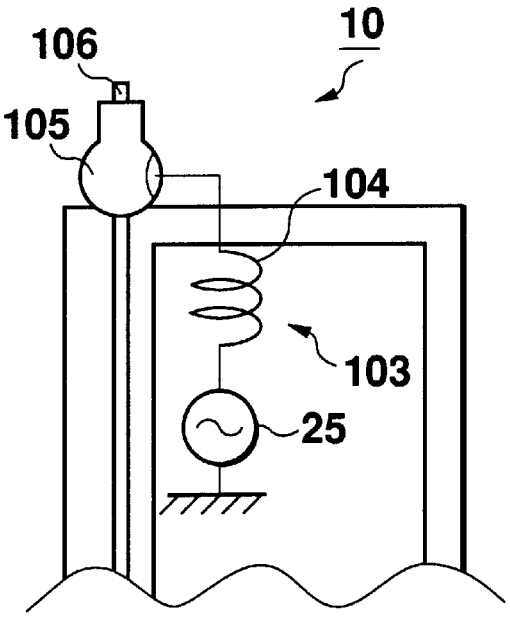
FIGS. 57 and 58 illustrate a modified example of the ninth embodiment.
Figure 58:
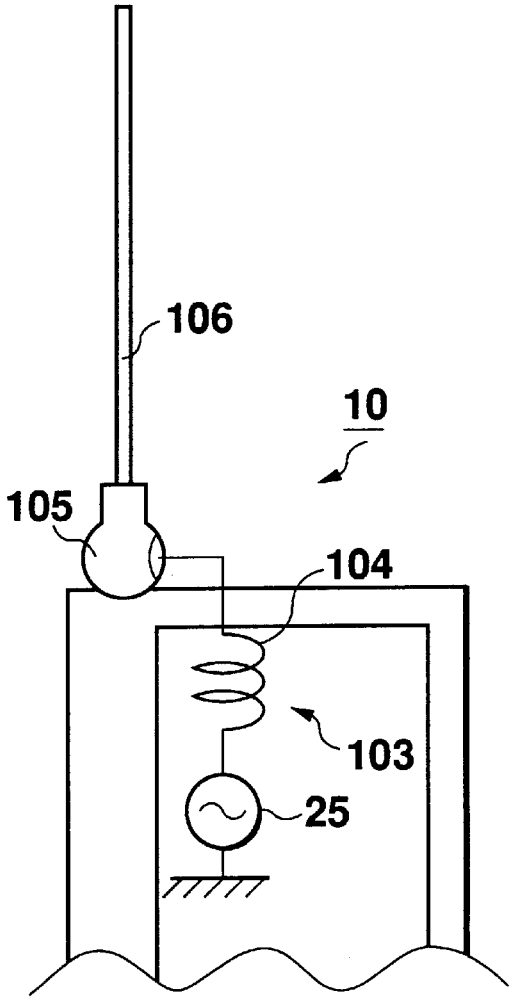

The ninth embodiment may employ in place of the contained helical antenna 100 a circuit antenna 103 comprising a capacitance and a reactance. The circuit antenna 103 comprises a reactance element 104 connected to the high-frequency signal source 25. When a high-frequency signal is supplied to the metallic rotator 105 at the storage position of the whip antenna 104, as shown in FIG. 57, the rotator 105 causes an electromagnetic connection so as to induce an electrical current in the whip antenna 106 which is not electrically connected to the rotator 105. A capacitance is established between the metallic rotator 105 and the tip of the whip antenna 106 so that the whip antenna 106 allows LC resonance to radiate radio waves. An electromagnetical connection likewise allows the whip antenna 106 to radiate radio waves at the extended position as shown in FIG. 58. Since the reactance element 104 can be employed as a second antenna in place of the helical or meander line antenna, it is possible to reduce the cost of the antenna device.

Figure 59:
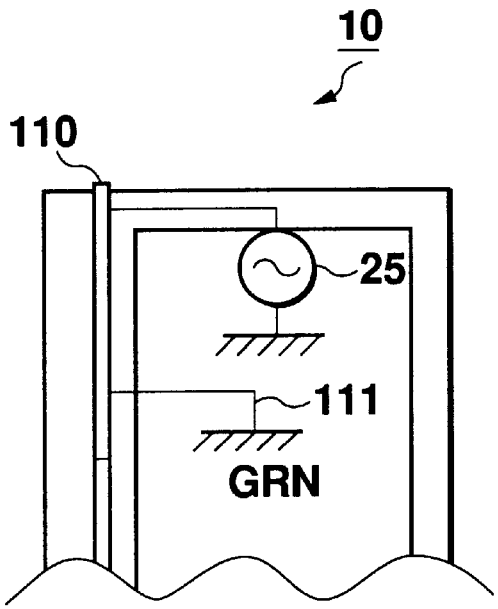
FIGS. 59 and 60 illustrate a portable information terminal employing an antenna device according to a tenth embodiment of the present invention.
Figure 60:
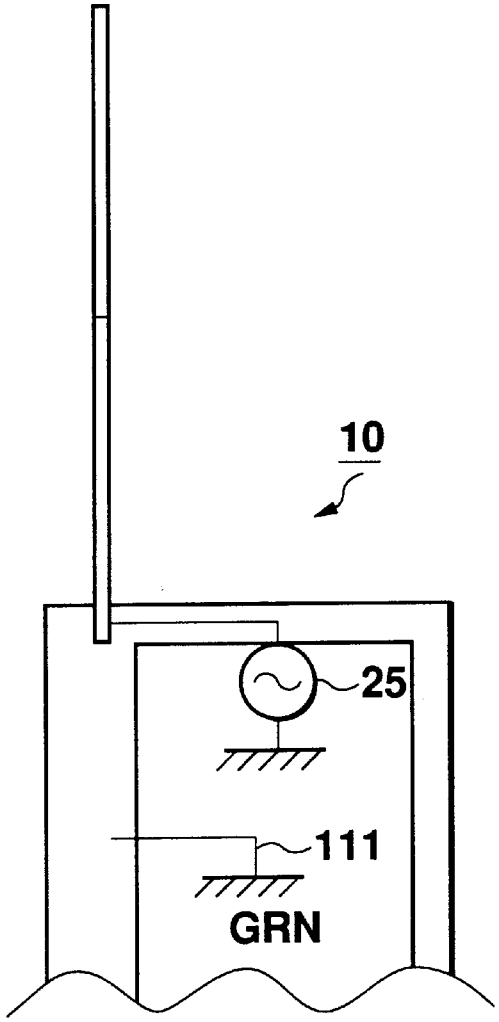

FIGS. 59 and 60 illustrate a portable information terminal 10 employing an antenna device according to a tenth embodiment of the present invention. The tenth embodiment is characterized in that attenuation in radiation efficiency of the first antenna can be prevented by matching to an impedance of the first antenna at the storage position. The antenna device comprises an impedance control circuit 111 for contacting the whip antenna 110 as the first antenna at the storage position so as to establish a matched impedance. The impedance control circuit 111 shorts the whip antenna to the ground GRN. As a result, radiation efficiency can be improved at the storage position of the first antenna without an antenna.

What is claimed is:

1. An antenna device comprising:

a first antenna capable of moving between a storage position where the first antenna is contained within an equipment housing and an extended position where the first antenna is pulled out of the equipment housing for receiving and/or transmitting a signal;

a second antenna attached to a tip of the first antenna for receiving and/or transmitting a signal when the first antenna assumes the storage position;

rotation means capable of rotating the first antenna in the extended position with respect to the equipment housing wherein said rotation means comprises:

a conductive shaft attached to the equipment housing, a rotator rotating about the conductive shaft, and a through hole formed in the rotator, said through hole receiving the second antenna when the first antenna assumes the storage position and receiving the first antenna when the first antenna assumes the extended position, signal feeder provided in the through hole for contacting the second antenna when the first antenna is in storage position and for contacting the first antenna when the first antenna is in the extended position, wherein said conductive shaft supplies the signal to the first and second antennas through the signal feeder.

2. An antenna device as defined in claim 1, wherein the first and second antennas are connected to each other via an insulator.

3. An antenna device as defined in claim 1, wherein the first and second antennas are directly connected to each other.

4. An antenna device as defined in claim 1, wherein at least one of the first and second antennas comprises either a helical antenna or a meander line antenna.

5. An antenna device as defined in claim 1, wherein the first antenna comprises either a linear antenna or a planar antenna.

6. An antenna device as defined in claim 1, wherein the first and second antennas are set to have electrical lengths of a quarter wavelength.

7. An antenna device as defined in claim 1, wherein the first and second antennas are set to have electrical lengths in a range of a quarter wavelength to a half wavelength.

8. An antenna device as defined in claim 1, wherein the first and second antennas are set to have electrical lengths of longer than a half wavelength.

9. An antenna device as defined in claim 1, wherein the first antenna rotates in a plane perpendicular to a surface of the equipment housing.

10. An antenna device as defined in claim 1, wherein the first antenna rotates in a plane inclined with respect to a surface of the equipment housing by an angle less than or equal to 90 degrees.

11. An antenna device as defined in claim 1, wherein the first antenna rotates in a range of 180 degrees.

12. An antenna device as defined in claim 1, further comprising a withdrawal prevention piece for preventing the first antenna from withdrawing from the extended position when the first antenna is rotated with respect to the equipment housing.

13. An antenna device as defined in claim 12, further comprising a click mechanism for temporarily holding the rotation means when the withdrawal prevention piece prevents the first antenna from withdrawing from the extended position. support piece is rotatably supported on the equipment housing.

* * * * *